US005859502A

United States Patent [19]

Spindt et al.

[11] Patent Number: 5,859,502

[45] Date of Patent: Jan. 12, 1999

[54] SPACER LOCATOR DESIGN FOR THREE-DIMENSIONAL FOCUSING STRUCTURES IN A FLAT PANEL DISPLAY

[75] Inventors: Christopher J. Spindt, Menlo Park; John E. Field, Santa Cruz, both of Calif.

[73] Assignee: Candescent Technologies Corporation, San Jose, Calif.

[21] Appl. No.: 684,270

[22] Filed: Jul. 17, 1996

[51] Int. Cl.[6] ..... H01J 19/42; H01J 29/18

[52] U.S. Cl. ..... 315/169.3; 315/169.1; 445/24; 313/495; 313/497

[58] Field of Search ..... 313/495, 497; 315/169.1, 169.3; 445/24; 156/272.2; 427/510, 77

[56] References Cited

U.S. PATENT DOCUMENTS

| | | | |
|---|---|---|---|
| 3,935,499 | 1/1976 | Oess | 313/413 |
| 4,174,523 | 11/1979 | Marlowe et al. | 358/67 |
| 4,451,759 | 5/1984 | Heynisch | 313/495 |
| 4,769,575 | 9/1988 | Murata et al. | 313/495 |
| 4,857,799 | 8/1989 | Spindt et a. | 313/495 |
| 4,900,981 | 2/1990 | Yamazaki et al. | 313/422 |
| 4,923,421 | 5/1990 | Brodie et al. | 445/24 |
| 5,003,219 | 3/1991 | Muragishi et al. | 313/456 |
| 5,015,912 | 5/1991 | Spindt et al. | 313/495 |
| 5,063,327 | 11/1991 | Brodie et al. | 313/482 |
| 5,160,871 | 11/1992 | Tomii et al. | 315/366 |
| 5,229,691 | 7/1993 | Shichao et al. | 315/366 |
| 5,424,605 | 6/1995 | Lovoi | 313/422 |
| 5,448,131 | 9/1995 | Taylor et al. | 313/309 |
| 5,486,126 | 1/1996 | Cathey et al. | 445/25 |
| 5,528,103 | 6/1996 | Spindt et al. | 313/497 |
| 5,529,524 | 6/1996 | Jones | 445/24 |
| 5,532,548 | 7/1996 | Spindt et al. | 313/422 |
| 5,543,683 | 8/1996 | Havan et al. | 313/461 |
| 5,562,517 | 10/1996 | Taylor et al. | 445/25 |
| 5,578,899 | 11/1996 | Haven et al. | 313/422 |
| 5,589,731 | 12/1996 | Fahlen et al. | 313/495 |
| 5,598,056 | 1/1997 | Jin et al. | 313/495 |
| 5,619,097 | 4/1997 | Jones | 313/495 |
| 5,650,690 | 7/1997 | Haven | 313/422 |
| 5,663,608 | 9/1997 | Jones et al. | 313/309 |
| 5,667,418 | 9/1997 | Fahlen et al. | 445/25 |
| 5,675,212 | 10/1997 | Schmid et al. | 313/422 |

FOREIGN PATENT DOCUMENTS

| | | |
|---|---|---|
| 0 050 294 A1 | 4/1982 | European Pat. Off. . |
| 0 436 997 A1 | 7/1991 | European Pat. Off. . |
| 0 523 702 A1 | 1/1993 | European Pat. Off. . |
| 0 580 244 A1 | 1/1994 | European Pat. Off. . |
| 0 780 872 A1 | 6/1997 | European Pat. Off. . |
| 0 780 873 A1 | 6/1997 | European Pat. Off. . |
| WO 97/15912 | 5/1997 | WIPO . |

OTHER PUBLICATIONS

Takahashi et al, "Back Modulation Type Flat CRT," Japanese Display '92, 1992, pp. 377–380.

*Primary Examiner*—Arnold Kinkead
*Attorney, Agent, or Firm*—Skjerven, Morrill, MacPherson, Franklin & Friel LLP; Ronald J. Meetin

[57] ABSTRACT

A flat panel display has a faceplate structure, a backplate structure, a focusing structure, and a plurality of spacers. The backplate structure includes an electron emitting structure which faces the faceplate structure. The focusing structure has a first surface coupled to the electron emitting structure, and a second surface which extends away from the electron emitting structure. The electrical end of the combination of the focusing structure and the electron emitting structure is located at an imaginary plane located intermediate the first and second surfaces of the focusing structure. A spacers is located between the focusing structure and the light emitting structure. The spacer is typically located within a corresponding groove in the focusing structure such that the electrical end of the spacer is coincident with the electrical end of the combination of the focusing structure and the electron emitting structure. In other embodiments, the electrical end of the spacer is located above the electrical end of the combination of the focusing structure and the electron emitting structure. In these embodiments, a face electrode on the spacer compensates for the resulting voltage distribution.

35 Claims, 20 Drawing Sheets

SPACER LOCATOR DESIGN FOR THREE-DIMENSIONAL FOCUSING STRUCTURES IN A FLAT PANEL DISPLAY

FIELD OF THE INVENTION

The present invention relates to a structure and method of locating spacers between a faceplate structure and a backplate structure of a flat panel display. More specifically, the invention relates to a structure and method for locating spacers on a focusing structure positioned on the backplate structure of a flat panel display.

BACKGROUND OF THE INVENTION

Flat cathode ray tube (CRT) displays include displays which exhibit a large aspect ratio (e.g., 10:1 or greater) with respect to conventional deflected-beam CRT displays, and which display an image in response to electrons striking a light emissive material. The aspect ratio is defined as the ratio of the diagonal length of the display surface to the display thickness. The electrons which strike the light emissive material can be generated by various devices, such as by field emitter cathodes or thermionic cathodes. As used herein, flat CRT displays are referred to as flat panel displays.

Conventional flat panel displays typically include a faceplate structure and a backplate structure which are joined by connecting walls around the periphery of the faceplate and backplate structures. The resulting enclosure is usually held at a vacuum pressure, typically around $1\times10^{-7}$ torr or less. To prevent collapse of the flat panel display under the vacuum pressure, a plurality of electrically resistive spacers are typically located between the faceplate and backplate structures at a centrally located active region of the flat panel display.

FIG. 1 is a cross sectional and schematic view of a portion of a conventional flat panel display 100. Flat panel display includes faceplate structure 120, backplate structure 130, spacer 140 and high voltage supply 150. Although only one spacer 140 is shown in FIG. 1, it is understood that flat panel display 100 includes similar additional spacers which are not shown.

Faceplate structure 120 includes an insulating faceplate 121 (typically glass) and a light emitting structure 122 formed on an interior surface of the faceplate 121. Light emitting structure 122 typically includes light emissive materials, such as phosphors, which define the active region of the display 100. Light emitting structure 122 also includes an anode (not shown) which is connected to the positive (high voltage) side of voltage supply 150.

Backplate structure 130 includes an insulating backplate 131 and an electron emitting structure 132 located on an interior surface of backplate 131. Electron emitting structure 132 includes a plurality of electron-emitting elements 161–165 which are selectively excited to release electrons. Electron emitting structure 132 is connected to the low voltage side of voltage supply 150. Because light emitting structure 122 is held at a relatively high positive voltage (e.g., 5 kV) with respect to electron emitting structure 132, the electrons released by the electron-emitting elements 161–165 are accelerated toward corresponding light emissive elements on the light emitting structure 122, thereby causing the light emissive elements to emit light which is seen by a viewer at the exterior surface of the faceplate 121 (the "viewing surface").

Spacer 140 is connected between the substantially planar lower surface of light emitting structure 122 and the substantially planar upper surface of electron emitting structure 132. If spacer 140 is made of a uniform material having a constant resistivity, the voltage distribution along spacer 140 is approximately equal to the voltage distribution in free space between electron emitting structure 132 and light emitting structure 122.

FIG. 2 is a cross sectional and schematic diagram of another conventional flat panel display 200. Because flat panel display 200 is similar to flat panel display 100, similar reference elements in flat panel displays 100 and 200 are labeled with similar reference numbers. Flat panel display 200 additionally includes focusing structures 133*a*–133*f*. One edge of spacer 140 contacts focusing structure 133*a*, and the opposite edge of spacer 140 contacts light emitting structure 122.

Focusing structures 133*a*–133*f* are electrically connected to the low voltage side of voltage supply 150. As a result, focusing structures 133*a*–133*f* assert repulsive forces on the electrons emitted from electron emitting elements 161–165. These repulsive forces tend to direct or focus stray electrons toward the appropriate light emitting elements on light emitting structure 122.

However, combining focusing structures 133*a*–133*f* with electron emitting structure 132 results in a substantially non-planar equal potential surface. That is, the upper surface of electron emitting structure 132 and the upper surfaces of focusing structures 133*a*–133*f* are at approximately the same potential, e.g., 0 Volts. This non-planar equal potential surface can cause the voltage distribution along spacer 140 to be different from the voltage distribution in free space between electron emitting structure 132 and light emitting structure 122. These unequal voltage distributions can result in undesired deflection of electrons emitted from electron emitting elements adjacent to spacer 140 (e.g., electron emitting elements 161 and 162).

It would therefore be desirable to have a method and structure for locating a spacer between a light emitting structure and a focusing structure which maintains a voltage distribution along the spacer which is equal to the voltage distribution in free space between the electron emitting structure and the light emitting structure.

SUMMARY

In accordance with the present invention, a flat panel display is provided having a faceplate structure, a backplate structure, a focusing structure, and one more spacer. The backplate structure includes an electron emitting structure which faces the faceplate structure. The focusing structure has a lower surface which is located on the electron emitting structure, and an upper surface which extends away from the electron emitting structure. The electron emitting structure and the focusing structure are maintained at approximately the same voltage. The combination of the focusing structure and the electron emitting structure has an electrical end which is located at an imaginary plane intermediate the upper and lower surfaces of the focusing structure. This electrical end is an imaginary plane which, if held at the same voltage as the electron emitting structure and the focusing structure, would have the same electrical capacitance to the faceplate as the combination of the electron emitting structure and the focusing structure.

The spacers are located between the focusing structure and the light emitting structure. Each spacer extends into a corresponding groove in the focusing structure, such that an electrical end of each spacer is located coincident with the electrical end of the combination of the focusing structure and the electron emitting structure. This has the desirable result that the voltage distribution along each spacer is substantially similar to the voltage distribution in free space between the faceplate structure and the combination of the focusing structure and electron emitting structure. More specifically, the voltage distributions are the same except for deviations very near either end of each of the spacers. These similar voltage distributions advantageously minimize the deflection of electrons at locations adjacent to the spacers.

In one embodiment, the grooves are located in the upper surface of the focusing structure. The grooves can have a depth such that the electrical end of the focusing structure and the electron emitting structure is coincident with the bottom of the groove. An electrically conductive edge electrode is located at an edge of each spacer. Each edge electrode defines an electrical end of the corresponding spacer. The edge electrodes are positioned in the grooves, such that the electrical end of each spacer corresponds with the electrical end of the focusing structure and the electron emitting structure.

In another embodiment, each of the spacers includes one or more electrically conductive face electrodes which contact the edge electrode and extend partially over one or more of the face surfaces of the spacer. The face electrodes, in combination with the edge electrode, relocate the electrical end of each spacer to an electrical end plane within the spacer which is distal from the edge electrode. The electrical end plane is located such that the spacer including the edge electrode and face electrodes exhibits the same resistance as a spacer having only an edge electrode located at the electrical end plane. In this embodiment, each groove has a depth which extends below the electrical end of the focusing structure and the electron emitting structure, such that the electrical ends of the spacers are coincident with the electrical end of the focusing structure and electron emitting structure.

In yet another embodiment, each spacer has an electrical end which is located above the electrical end of the focusing structure and the electron emitting structure. A face electrode is located on a face surface of each spacer. The voltage of each face electrode is controlled to create a voltage distribution adjacent to the face electrode which compensates for the negative voltage distribution caused by the electrical end of the spacer being located above the electrical end of the focusing structure and the electron emitting structure.

In one embodiment, the voltage of each face electrode is controlled by connecting the face electrode to the light emitting structure of the faceplate structure. In another embodiment, the voltage of each face electrode is controlled by a power supply. In another embodiment, the voltage of each face electrode is controlled by a voltage divider circuit. In yet another embodiment, the voltage of each face electrode is controlled by an electrically conductive extension electrode which is located on the face surface of the spacer which is opposite the surface on which the face electrode is located. The extension electrode, which is located outside of the active region of the flat panel display, contacts the edge electrode located adjacent to the faceplate structure and extends down the face surface of the spacer toward the backplate structure. In a further embodiment, the voltage of the face electrode is controlled by locating the face electrode at a predetermined height along the face surface of the spacer.

The present invention also includes a method of fabricating a flat panel display which includes the steps of: (1) providing a focusing structure over an electron emitting structure of the flat panel display, the focusing structure and the electron emitting structure having an electrical end, (2) forming a groove in the focusing structure and (3) locating a spacer having an electrical end in the groove, such that the electrical end of the focusing structure and the electron emitting structure is coincident with the electrical end of the spacer.

Another method according to the invention includes the steps of (1) providing a focusing structure over an electron emitting structure of the flat panel display, the focusing structure and the electron emitting structure having an electrical end, (2) locating the spacer on the focusing structure such that the electrical end of the spacer is located above the electrical end of the focusing structure and the electron emitting structure, (3) providing a face electrode on a face surface of the spacer, and (4) controlling the voltage of the face electrode to create a voltage distribution adjacent to the face electrode which cancels the negative voltage distribution caused by the electrical end of the spacer being located above the electrical end of the focusing structure and the electron emitting structure. By canceling the negative voltage distribution, the deflection of electrons emitted adjacent to the spacer is minimized.

The present invention will be more fully understood in view of the following detailed description taken together with the drawings.

DETAILED DESCRIPTION

The following definitions are used in the description below. Herein, the term "electrically insulating" (or "dielectric") generally applies to materials having a resistivity greater than $10^{12}$ ohm-cm. The term "electrically non-insulating" thus refers to materials having a resistivity below $10^{12}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{12}$ ohm-cm. These categories are determined at low electric fields.

Examples of electrically conductive materials (or electrical conductors) are metals, metal-semiconductor compounds, and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are cermet (ceramic with embedded metal particles) and other such metal-insulator composites. Electrically resistive materials also include conductive ceramics and filled glasses.

Figure 1:
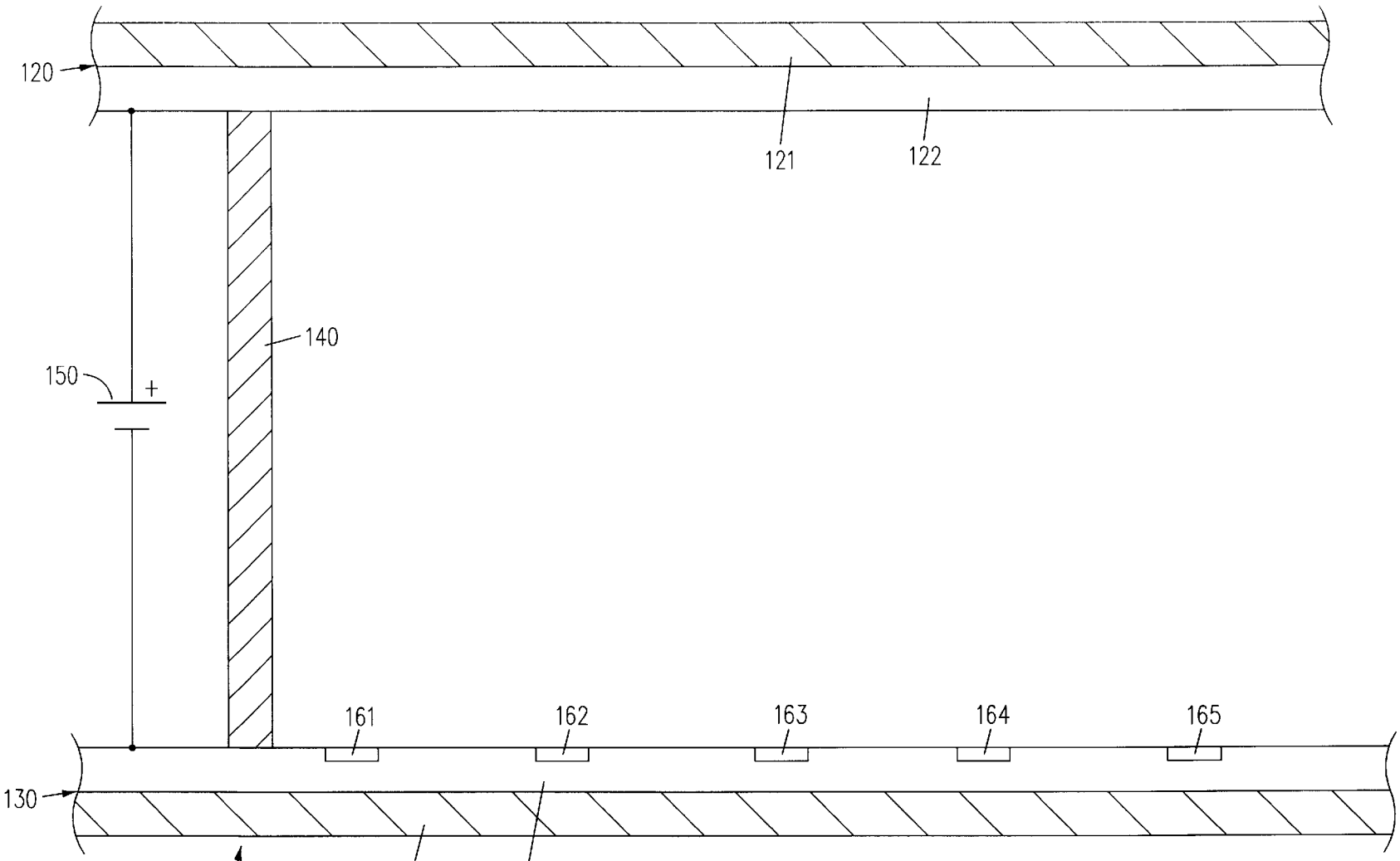
(PRIOR ART) FIG. 1
FIG. 1 is a cross sectional and schematic diagram of a conventional flat panel display.
Figure 2:
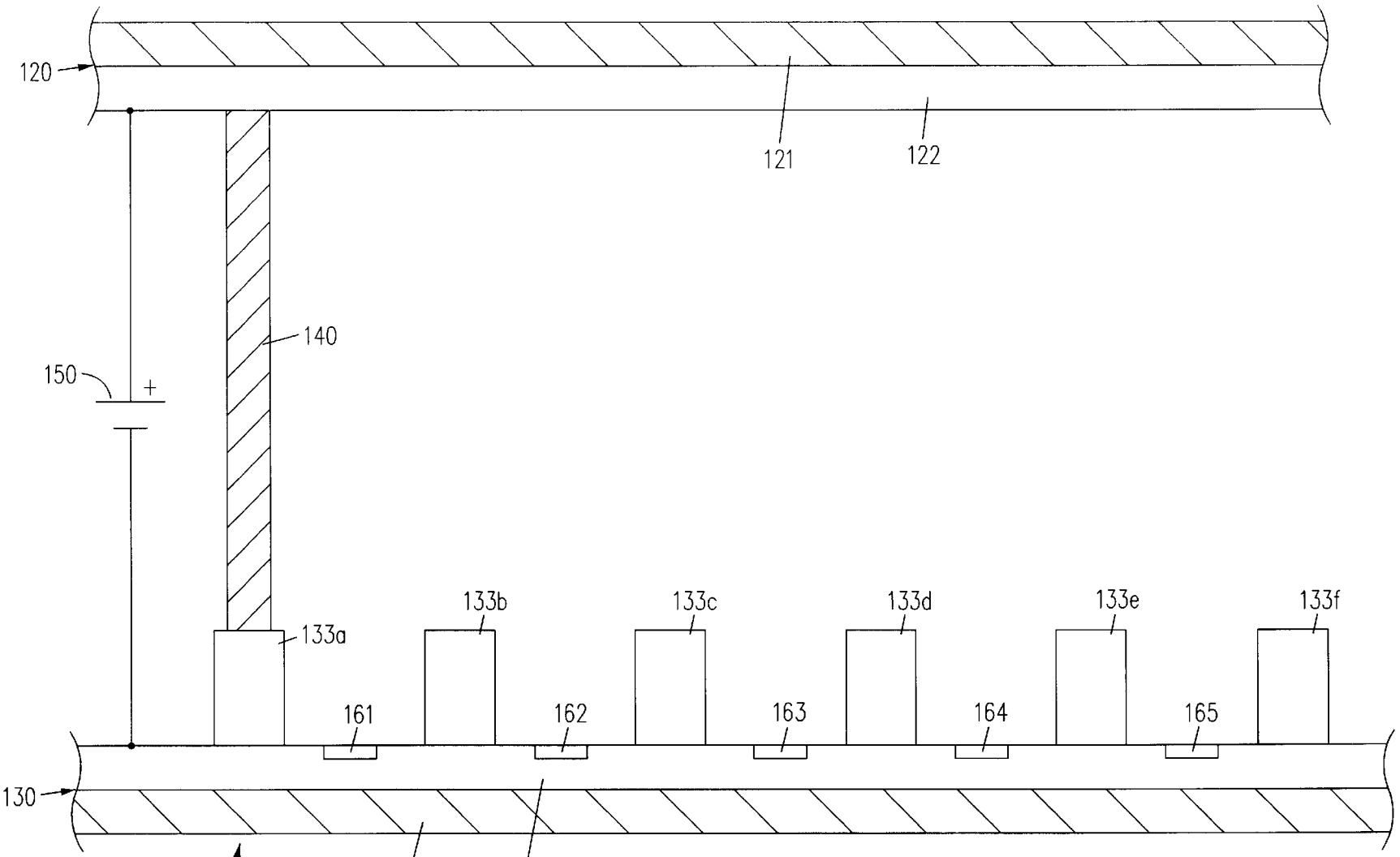
(PRIOR ART) FIG. 2
FIG. 2 is a cross sectional and schematic diagram of a conventional flat panel display having a plurality of focusing structures.
Figure 3:
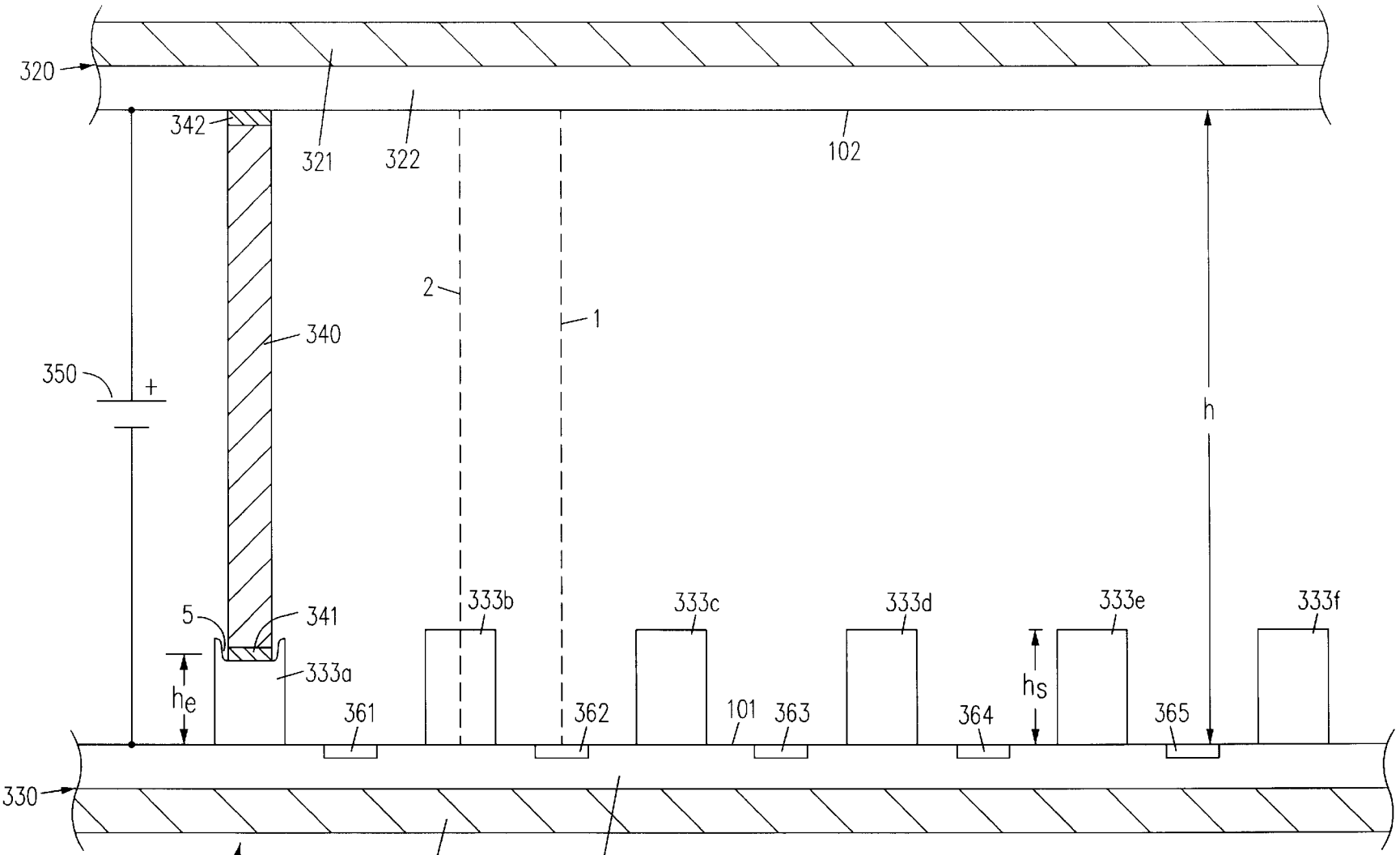
FIG. 3 is a cross sectional and schematic view of a flat panel display in accordance with one embodiment of the invention.

FIG. 3 is a cross sectional and schematic view of a flat panel display 300 in accordance with one embodiment of the invention. Flat panel display 300 includes faceplate structure 320, backplate structure 330, focusing structures 333*a*–333*f*, spacer 340 and high voltage supply 350. Although only one spacer 340 is shown in FIG. 3, it is understood that flat panel display 300 includes similar additional spacers which are not shown.

Faceplate structure 320 includes an electrically insulating faceplate 321 (typically glass) and a light emitting structure 322 formed on an interior surface of the faceplate 321. Light emitting structure 322 includes light emissive material (not shown) and an anode (not shown) which is connected to the positive (high voltage side) of voltage supply 350. As a result, light emitting structure 322 is held at a voltage of approximately V Volts, where V is typically a voltage in the range of 4 to 10 kV. In the described embodiment, light emitting structure 322 has a substantially planar lower surface 102. Faceplate structure 320 is described in more detail in commonly owned, U.S. Pat. No. 5,477,105, which is hereby incorporated by reference in its entirety.

Backplate structure 330 includes an electrically insulating backplate 331 and an electron emitting structure 332 located on an interior surface of backplate 331. Electron emitting structure 332 includes a plurality of electron-emitting elements 361–365 which are selectively excited to release electrons. Electron emitting elements 361–365 can be, for example, filamentary field emitters or conical field emitters. Electron emitting structure 332 is connected to the low voltage side of voltage supply 350. As a result, electron emitting structure 322 is held at a voltage of approximately 0 Volts. Because light emitting structure 322 is held at a relatively high positive voltage (e.g., 5 kV) with respect to electron emitting structure 332, electrons released by electron-emitting elements 361–365 are accelerated toward corresponding light emissive elements on light emitting structure 322. Backplate structure 330 is described in more detail in commonly owned, U.S. patent application Ser. No. 08/081,913, now U.S. Pat. No. 5,686,790, and PCT Publication WO 95/07543, published Mar. 16, 1995, both of which are hereby incorporated by reference in their entirety.

Focusing structures 333*a*–333*f* are located on the substantially planar upper surface 101 of electron emitting structure 322. Focusing structures 333*a*–333*f*, which are also connected to the low voltage side of voltage supply 350, are held at approximately the same voltage as electron emitting structure 322 (i.e., approximately 0 Volts). In one embodiment, each of focusing structures 333*a*–333*f* is a separate structure which extends along the length of flat panel display 300. In another embodiment, focusing structures 333*a*–333*f* are part of a focusing grid which includes cross members which are not shown in the cross sectional view of FIG. 3. Such focusing structures are described in more detail in commonly owned, U.S. patent application Ser. Nos. 08/188,855 and 08/343,074, now respectively U.S. Pat. Nos. 5,528,103 and 5,650,690, both of which are hereby incorporated by reference in their entirety.

Spacer 340 is connected between light emitting structure 322 and focusing structure 333*a*. Spacer 340 can be, for example, a wall, a partial wall, a post, a cross or a tee. Spacer 340 is made of a material having a substantially uniform electrical resistivity. Electrically conductive edge electrodes 341 and 342 are located at opposite edges of spacer 340. Edge electrode 341 contacts focusing structure 333*a*, and edge electrode 342 contacts light emitting structure 322. Edge electrodes 341 and 342 are typically metal. Spacer 340 and edge electrodes 341–342 are described in more detail in commonly owned, U.S. patent application Ser. Nos. 08/414,408 and 08/505,841, now respectively U.S. Pat. Nos. 5,675,212 and 5,614,781, both of which are hereby incorporated by reference in their entirety.

Spacer 340 is positioned in a groove 5 located in focusing structure 333*a*. Edge electrode 341 contacts focusing structure 333*a* within groove 5. The relatively high electrical conductivity of edge electrode 341 causes the voltage of focusing structure 333*a* at the bottom of groove 5 to be equal to the voltage at the bottom edge of spacer 340. The depth of groove 5 is selected to make spacer 340 "disappear". That is, the depth of groove 5 is selected such that the voltage distribution along spacer 340 is similar to the voltage distribution in free space between electron emitting structure 332 (and focusing structures 333*b*–333*f*) and light emitting structure 322.

Figure 4:
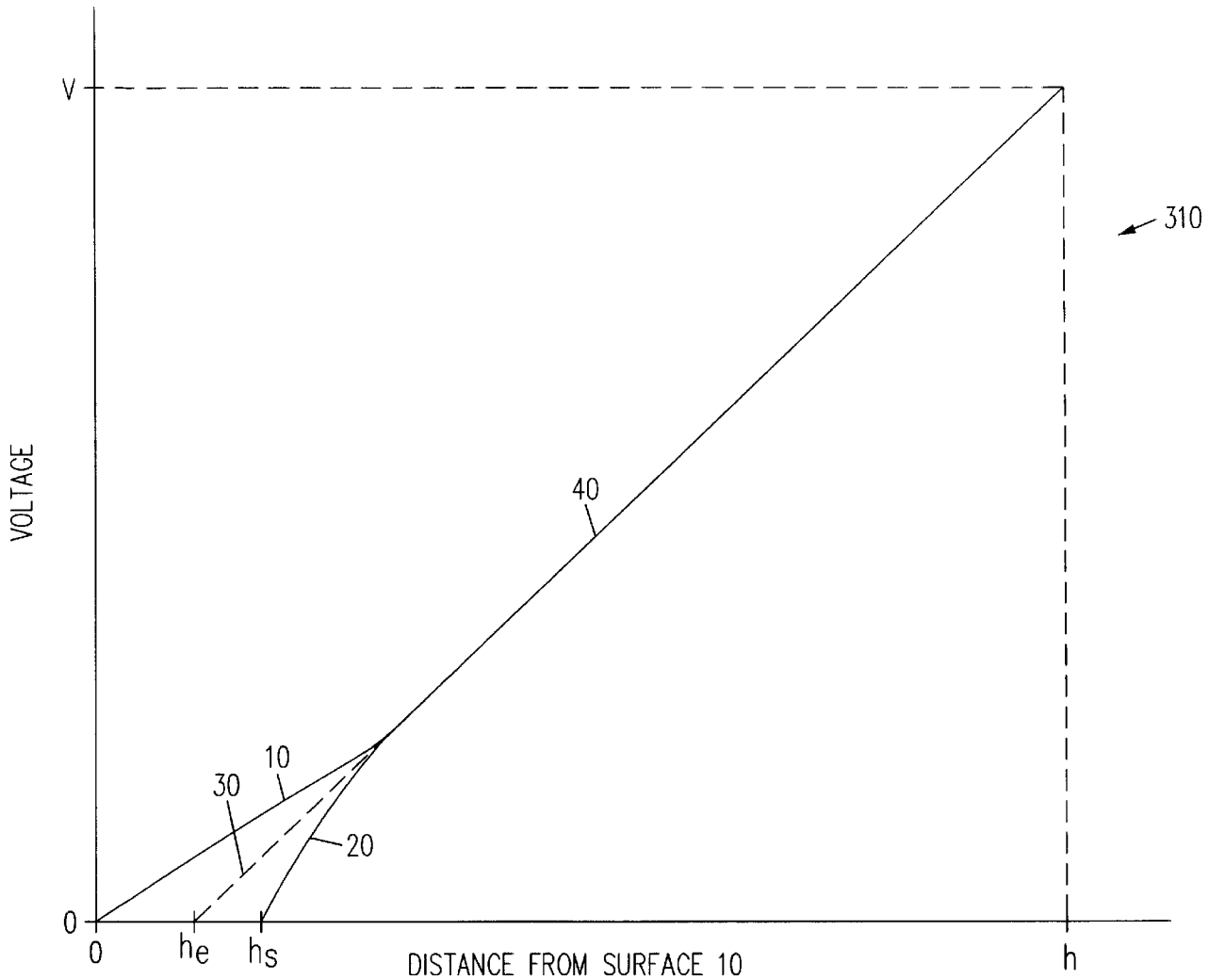
FIG. 4 is a graph which illustrates voltage versus height at various locations within the flat panel display of FIG. 3.

FIG. 4 is a graph 310 used to determine the appropriate depth of groove 5. The vertical axis of graph 310 represents the voltage within flat panel display 300. This voltage varies from 0 Volts at electron emitting structure 332 (and focusing structures 333*a*–333*f*), up to V Volts at light emitting structure 322. The horizontal axis of graph 310 illustrates the vertical height from planar surface 101 of electron emitting structure 332. This height varies from "0" at surface 101 of electron emitting structure 332, up to "h" at surface 102 of light emitting structure.

Curve 10 on graph 310 illustrates the voltage distribution along line 1 of FIG. 3. As illustrated in FIG. 3, line 1 extends from surface 101 of electron emitting structure 332 to surface 102 of light emitting structure 322. Curve 10 (FIG. 4) illustrates that the voltage at surface 101 along line 1 is equal to 0 Volts, and that the voltage at height "h" along line 1 is equal to V Volts.

Curve 20 on graph 310 illustrates the voltage distribution along line 2 of FIG. 3. As illustrated in FIG. 3, line 2 extends from the top of focusing structure 333*b* to surface 102 of light emitting structure 322. The top surface of focusing structure 333*b* is located at a height $h_s$ above surface 101. Curve 20 (FIG. 4) illustrates that the voltage at height $h_s$ along line 2 is equal to 0 Volts, and that the voltage at height "h" along line 2 is equal to V Volts. Focusing structures 333*c*–333*f* exhibit the same voltage distribution as focusing structure 333*b*.

As seen in FIG. 4, the curves 10 and 20 rapidly converge to a common line 40. Common line 40 has a slope which is greater than the average slope of curve 10 and less than the average slope of curve 20. Dashed line 30 illustrates the extrapolation of common line 40 to the horizontal axis of graph 310. Dashed line 30 intersects the horizontal axis of graph 310 at a height $h_e$. Common line 40 and dashed line 30 represent the average voltage distribution in free space between electron emitting structure 332 (and focusing structures 333*a*–333*f*) and light emitting structure 322. An approximately equivalent voltage distribution would be provided by a planar electrode which is held at a voltage of zero Volts, is located in parallel with surfaces 101 and 102, and is located at height $h_e$. Stated another way, the capacitance between light emitting structure 322 and an imaginary plate located at height $h_e$ is substantially equal to the capacitance between electron emitting structure 332 (and focusing structures 333*a*–333*f*) and light emitting structure 322. For these reasons, height $h_e$ is defined as the "electrical end" of electron emitting structure 332 and focusing structures 333*a*–333*f*.

To make spacer 340 "disappear" within this voltage distribution, the voltage distribution along spacer 340 must be similar to the voltage distribution in free space between electron emitting structure 332 (including focusing structures 333*a*–333*f*) and light emitting structure 322. To accomplish this, an edge electrode 341 is located at an edge surface of spacer 340. Edge electrode 341 forms the electrical end of spacer 340. Edge electrode 341 is positioned at the electrical end of electron emitting structure 332 and focusing structure 333*a*–333*f*. That is, edge electrode 341 is positioned at height $h_e$. In this manner, the bottom edge of spacer 340 is maintained at a voltage of 0 Volts at height $h_e$ (by edge electrode 341). The top edge of spacer 340 is maintained at a voltage of V Volts by edge electrode 342, which contacts the anode of light emitting structure 322. Because the electrical resistivity of spacer 340 is uniform, the voltage distribution along spacer 340 varies in a uniform manner from approximately 0 Volts at height $h_e$, up to approximately V Volts at height h. The voltage distribution along spacer 340 therefore substantially matches the voltage distribution in free space between electron emitting structure 332 (including focusing structures 333*a*–333*f*) and light emitting structure 322. The identity (sameness) of these voltage distributions along most of spacer 340 prevents the undesired deflection of electrons which are emitted from electron emitting elements, such as electron emitting element 361, which are located adjacent to spacer 340.

FIGS. 5–10 illustrate process steps for fabricating a focusing structure in accordance with one embodiment of the invention.

Figure 5:
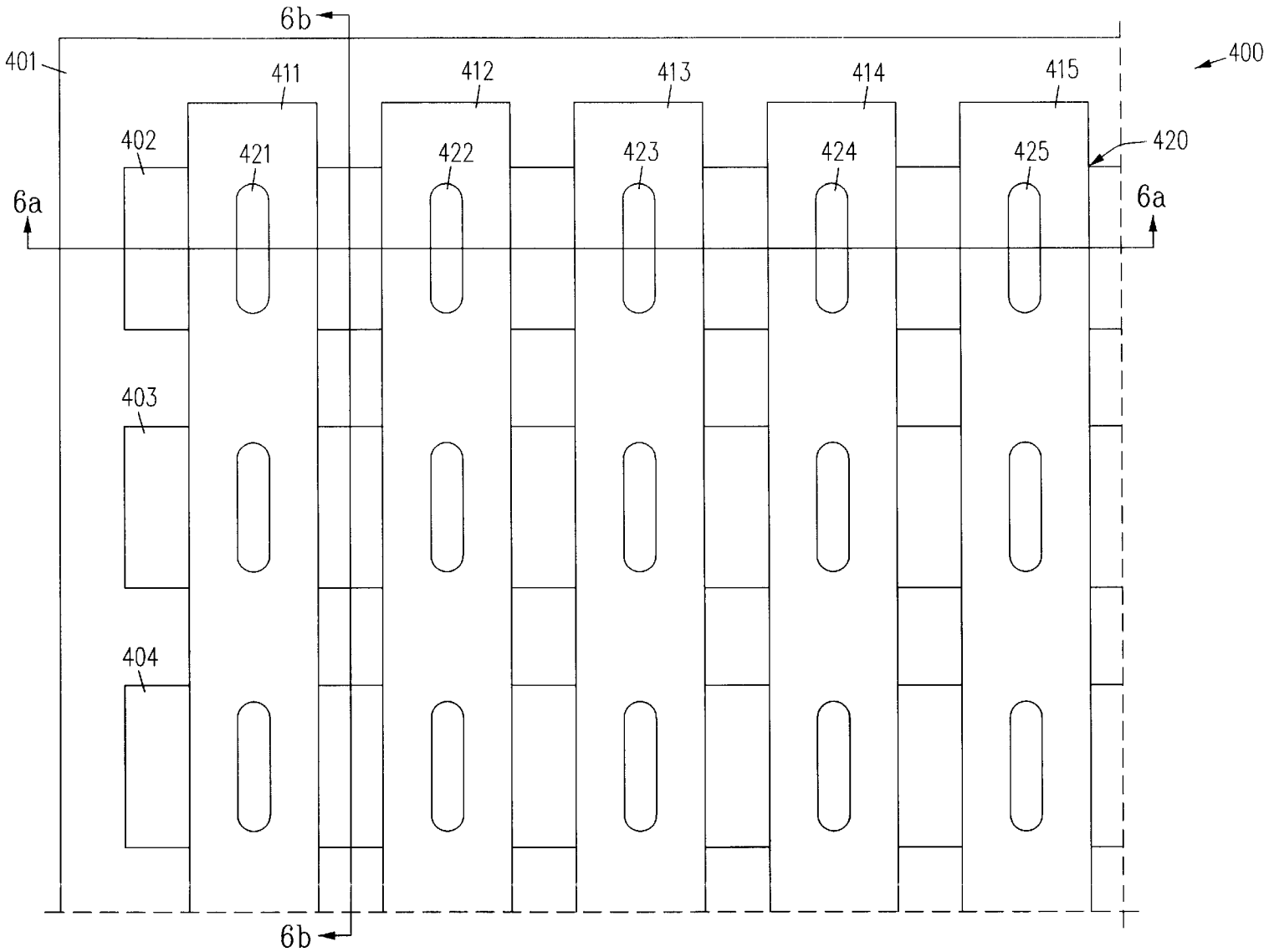
FIG. 5 is a top view of a backplate structure which includes a backplate and an electron emitting structure.
Figure 6A:
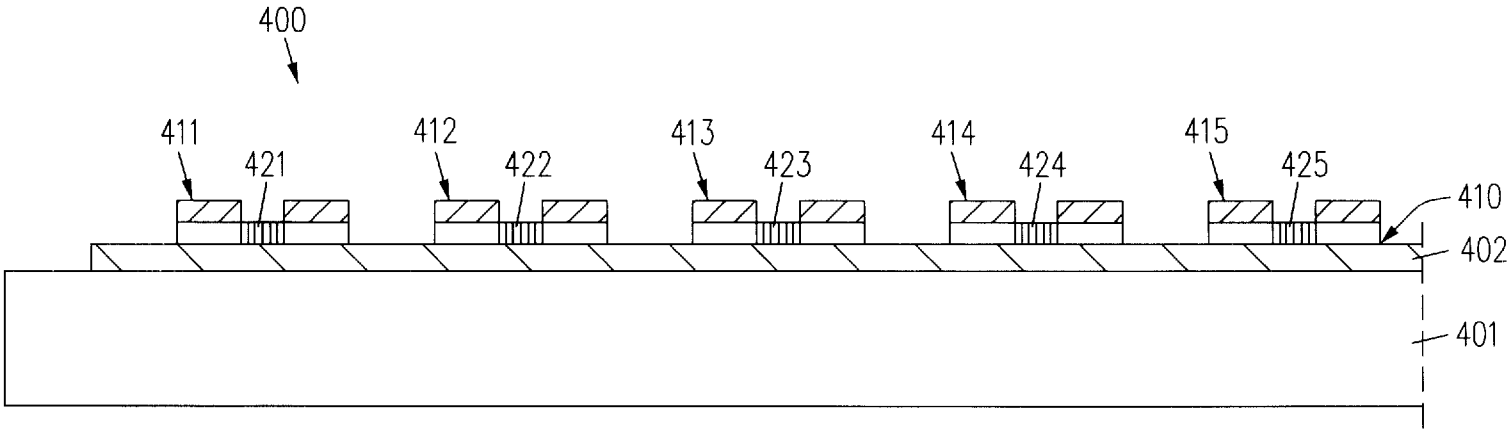
FIGS. 6*a* and 6*b* are cross sectional views along section lines 6*a*—6*a* and 6*b*—6*b*, respectively, of FIG. 5.
Figure 6B:
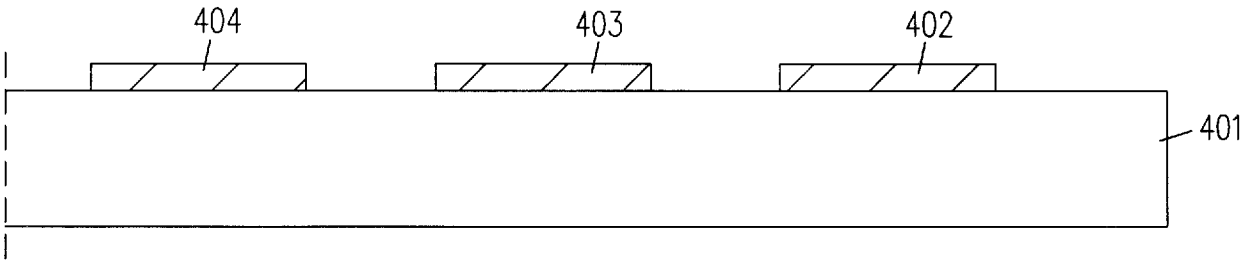

FIG. 5 is a top view of a portion of a backplate structure 400 which includes an insulating glass backplate 401 and an electron emitting structure 420. Electron emitting structure 420 includes a plurality of parallel row electrodes 402–404, a plurality of parallel column electrodes 411–415 and a plurality of electron emitting elements, such as electron emitting elements 421–425. The row electrodes 402–404 and column electrodes 411–415 are located perpendicular to one another, and the electron emitting elements 421–425 are located at the intersections of the row and column electrodes. FIG. 6*a* is a cross sectional view of backplate structure 400 along section line 6*a*—6*a* of FIG. 5. FIG. 6*b* is a cross sectional view of backplate structure 400 along section line 6*b*—6*b* of FIG. 5.

Figure 7A:
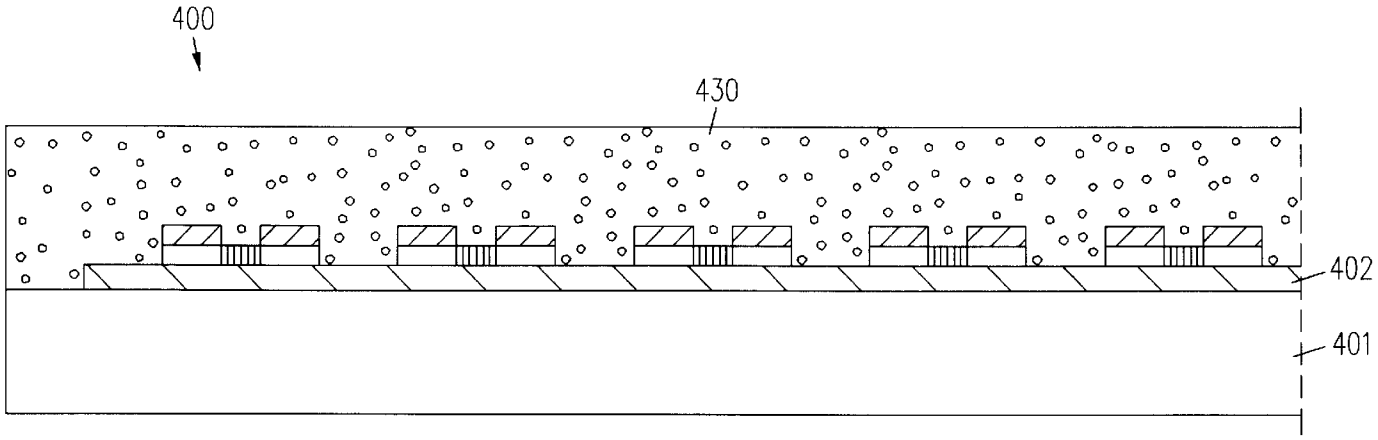
FIGS. 7*a*, 7*b*, 8*a* and 8*b* are cross sectional views illustrating process steps used to fabricate a focusing structure on the backplate structure of FIG. 5 in accordance with one embodiment of the invention.
Figure 7B:
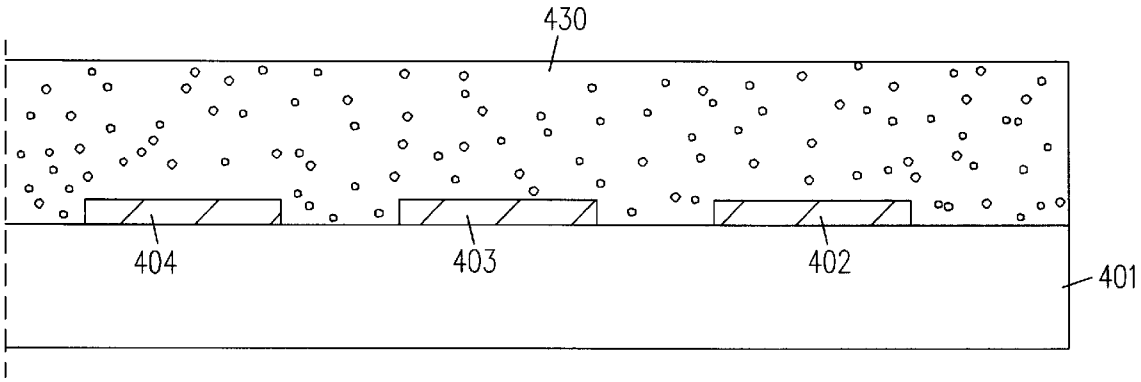

A planarized layer of negative-type photo-patternable polymer 430 is formed over the upper surface of backplate structure 400 as illustrated in FIGS. 7*a* and 7*b*. FIG. 7*a* is a cross sectional view of backplate structure 400 along section line 6*a*—6*a* of FIG. 5 after photo-patternable layer 430 has been formed. FIG. 7*b* is a cross sectional view of backplate structure 400 along section line 6*b*—6*b* of FIG. 5 after photo-patternable layer 430 has been formed. The thickness of photo-patternable layer 430 is selected to correspond to the desired height of the focusing structure to be fabricated.

Figure 8A:
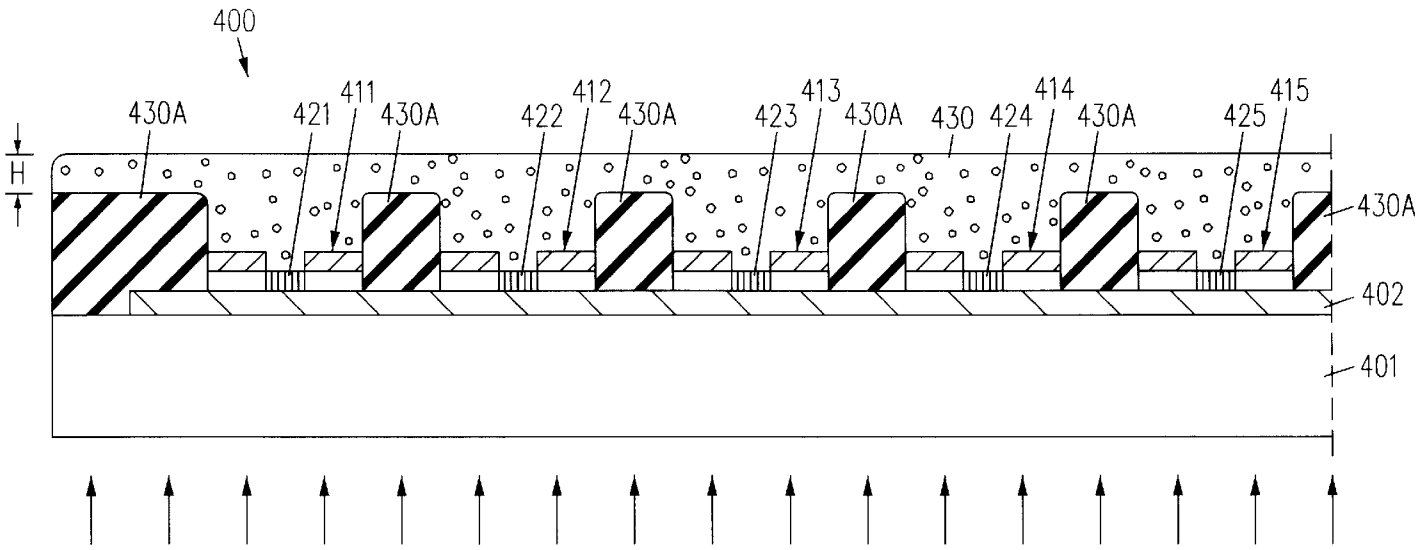
Figure 8B:
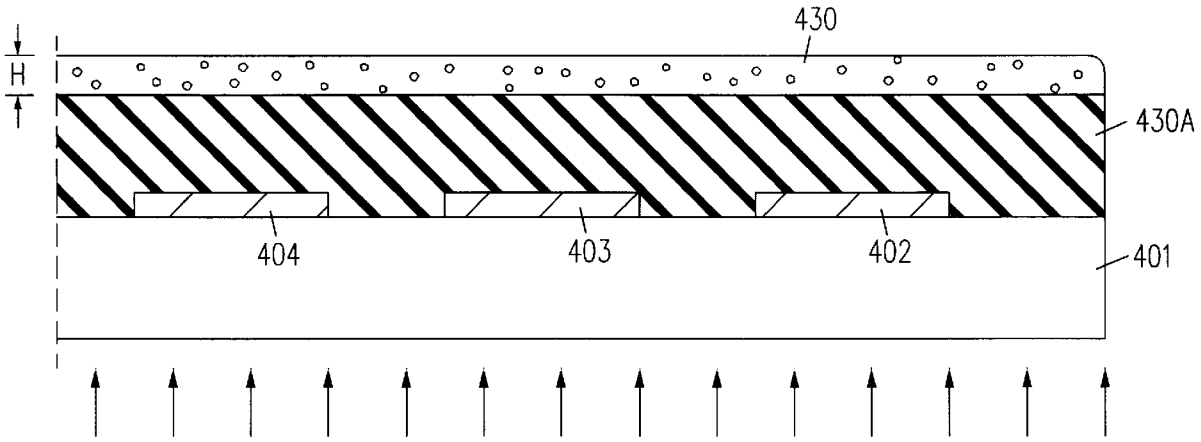

Photo-patternable polymer layer 430 is exposed to ultraviolet (U-V) light through the backside of backplate structure 400 as illustrated in FIGS. 8*a* and 8*b*. That is, the surface of glass backplate 401 which does not include the electron emitting structure 420 is exposed. The U-V light passes through the glass backplate 401. In addition, the characteristics of row electrodes 402–404 allow the U-V light to pass through the row electrodes as well. In the described embodiment, the row electrodes 402–404 are nickel-vanadium (Ni-V), and have a thickness of approximately 2000 Å. The characteristics of column electrodes 411–415 and electron emitting elements 421–425 are sufficient to block the U-V light. In the described embodiment, the column electrodes 411–415 are Ni-V, and have a thickness of approximately 2000 Å. Electron emitting elements 421 and 425 are molybdenum, and have a thickness of approximately 3000 Å. The elements of backplate structure 400 are described in more detail in commonly owned, co-pending U.S. patent application Ser. No. 08/081,913 and PCT Publication WO 95/07543, both cited above.

FIG. 8*a* is a cross sectional view of backplate structure 400 along section line 6*a*—6*a* of FIG. 5 after photo-patternable layer 430 has been formed and exposed. FIG. 8*b* is a cross sectional view of backplate structure 400 along section line 6*b*—6*b* of FIG. 5 after photo-patternable layer 430 has been formed and exposed. As a result of the exposure, regions 430A of photo-patternable layer 430 are cured (i.e., hardened). The exposure step is controlled such that the cured regions 430A do not extend all the way to the upper surface of photo-patternable layer 430. By controlling the exposure step, the height H between the upper surface of photo-patternable layer 430 and the uppermost regions of cured regions 430A can be precisely controlled. As described in more detail below, this height H will define the depth of the grooves in the finished focusing structure. In the described embodiment, this height H is approximately 30 to 70 $\mu$m, although the present invention is not limited by this range of heights.

Figure 9A:
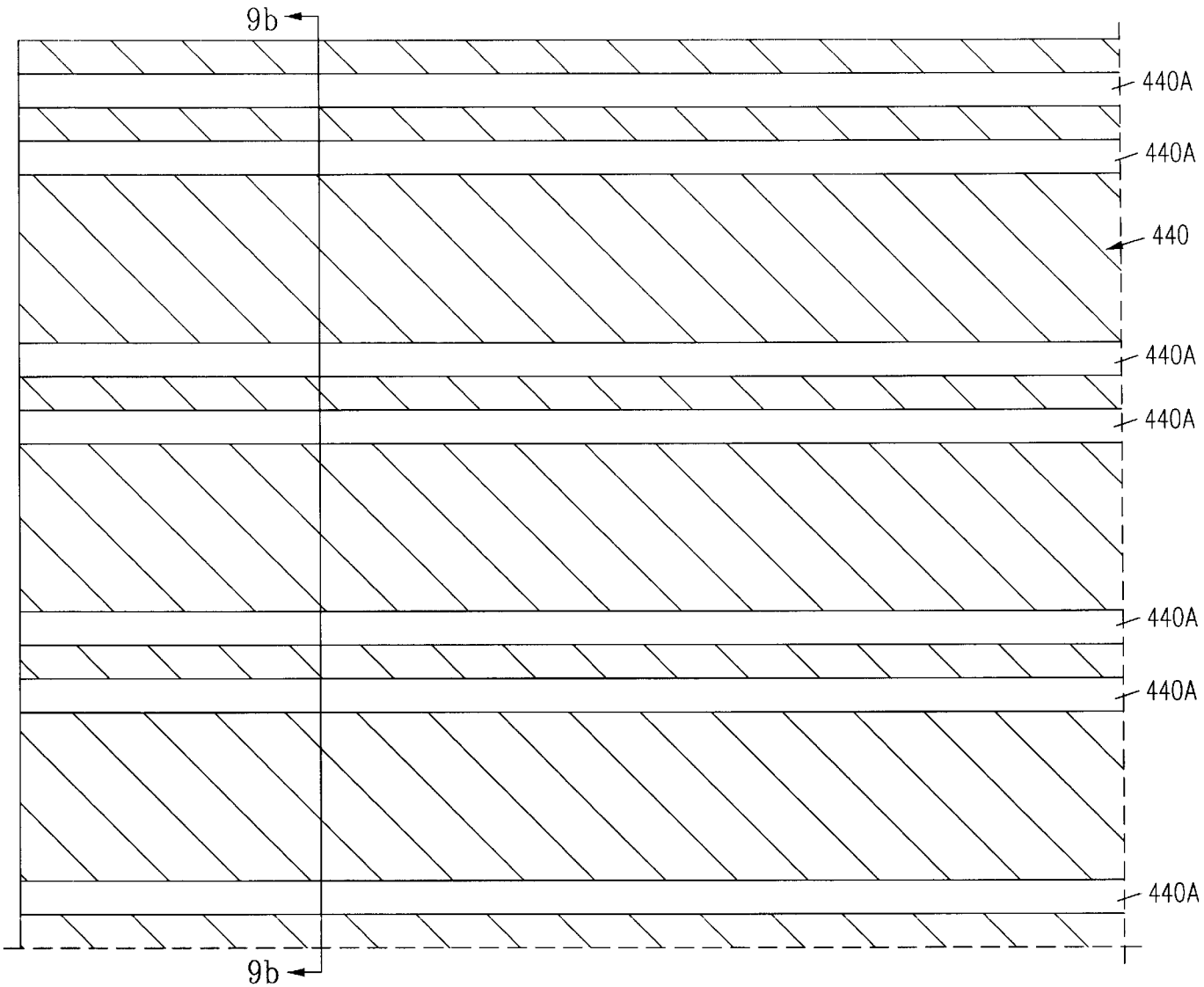
FIG. 9*a* is a top view.
Figure 9B:
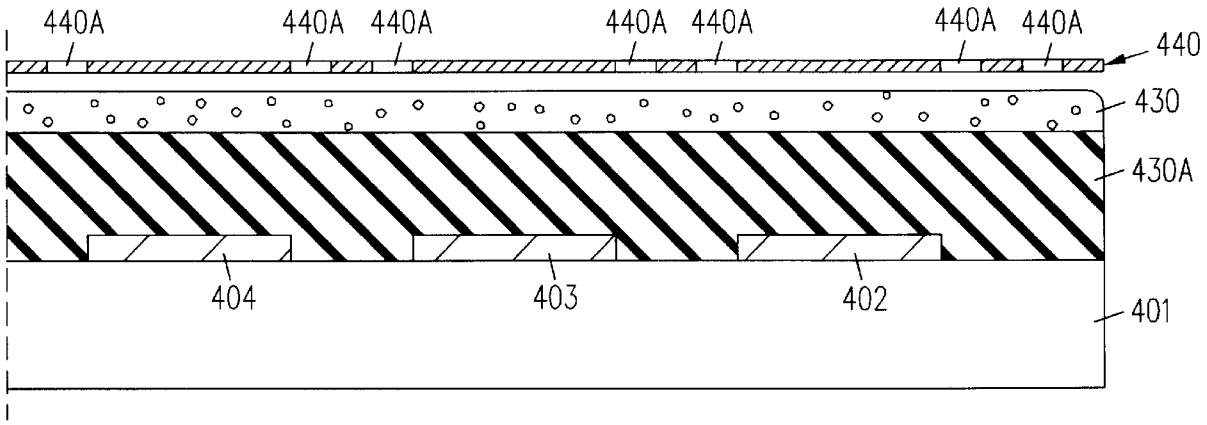
FIGS. 9*b*, 9*c* and 9*d* are cross sectional views, illustrating further process steps used to fabricate a focusing structure on the backplate structure of FIG. 5 in accordance with one embodiment of the invention.

The upper surface of photo-patternable layer 430 is then exposed through a reticle 440. FIG. 9*a* is a top view of reticle 440, which includes transparent portions 440A. Transparent portions 440A expose selected portions of underlying photo-patternable layer 430. FIG. 9*b* is a cross sectional view of backplate structure 400 along section line 9*b*—9*b* of FIG. 9*a*.

Figure 9C:
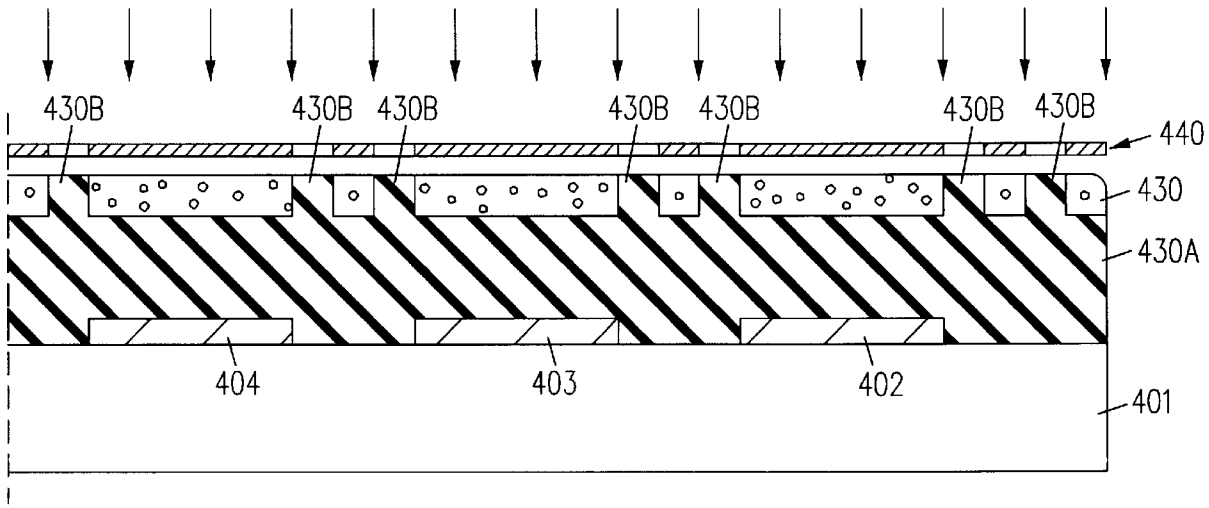
Figure 9D:
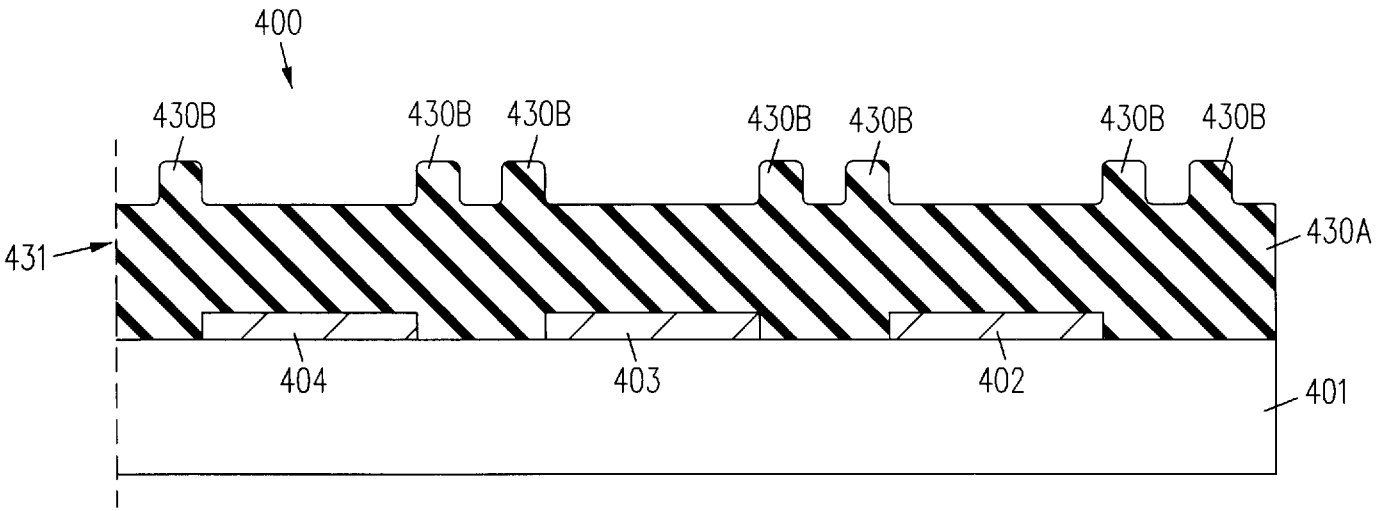

As illustrated in FIG. 9*c*, photo-patternable layer 430 is exposed through reticle 440 (i.e., from the upper surface of backplate structure 400). This exposure cures regions 430B of photo-patternable layer 430. Cured regions 430B extend down into photo-patternable layer 430 such that portions of cured regions 430B are continuous with portions of cured regions 430A. The uncured portions of photo-patternable layer 430 are then stripped, leaving the cured regions 430A and 430B as illustrated in FIG. 9*d*. Cured regions 430A and 430B form a focusing structure 431.

Figure 10:
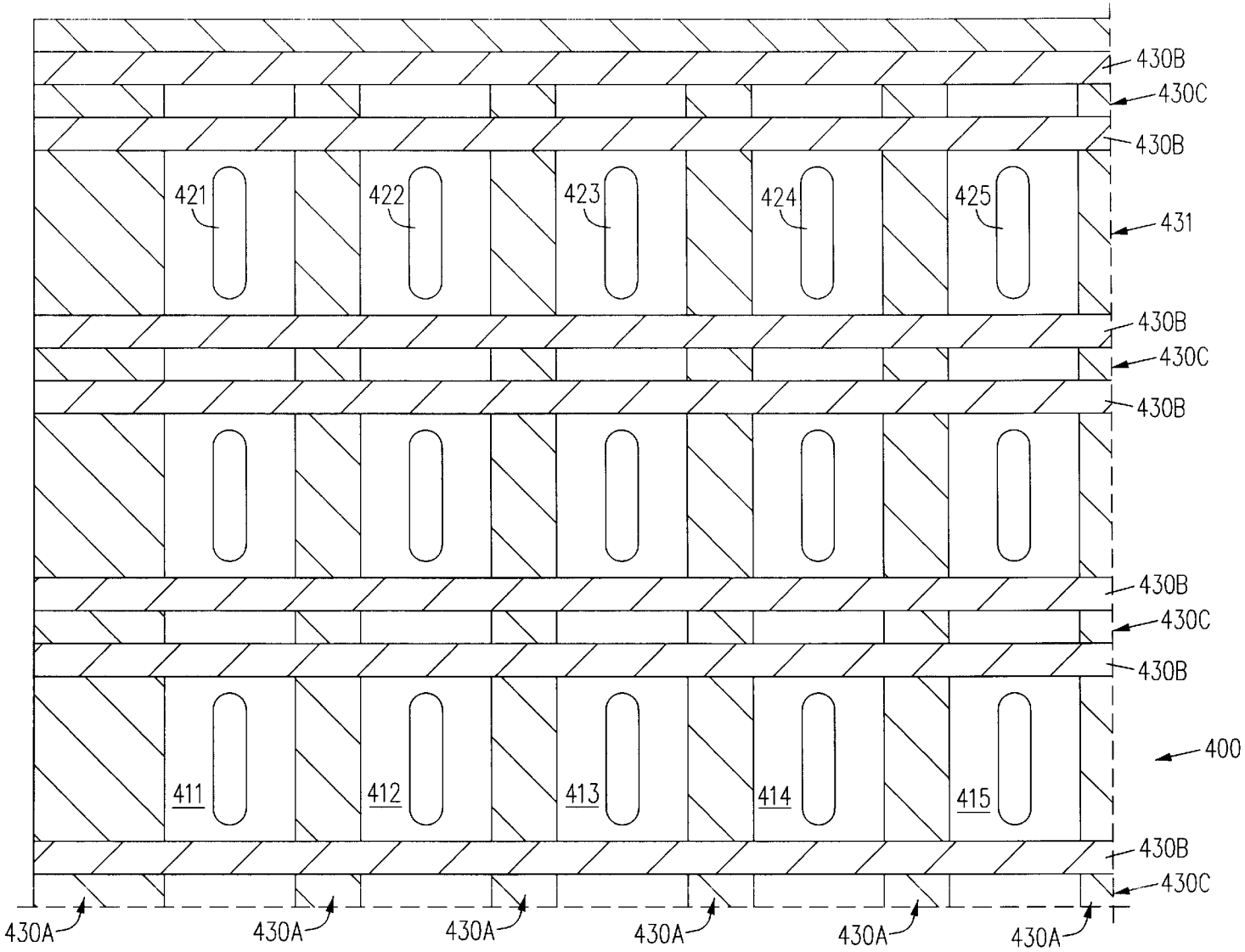
FIG. 10 is a top view of the backplate structure of FIG. 5 after a focusing structure has been fabricated thereon.

FIG. 10 is a top view which clearly illustrates the remaining focusing structure 431 formed by cured regions 430A and 430B. Focusing structure 431 has a "grid" or "waffle" shape. In the locations where cured portions 430B do not overlie cured portions 430A, cured portions 430B extend down to column electrodes 411–415. Spacers (not shown) can be located in the grooves 430C. Cured portions 430B define the sidewalls of grooves 430C and cured portions 430A define the bottoms of grooves 430C. Although grooves 430C are illustrated between each row of electron emitting elements, spacers are typically not located in each of grooves 430C. For example, in one embodiment, spacers are located in every thirtieth groove 430C. In an alternative embodiment, mask 440 is modified such that cured portions 430B only exist at the locations where a spacer is to be located.

As previously described, the backside exposure of photopatternable layer 430 is controlled to precisely control height H. By controlling height H, the depth of grooves 430C is controlled. In the described embodiment, the depth of grooves 430C is selected to coincide with the height $h_e$ of the electrical end of the combination of the electron emitting structure 420 and the focusing structure 431. The height $h_e$ increases as the height H decreases. Conversely, the height $h_e$ decreases as the height H increases. Thus, slight errors which may occur in forming cured portions 430A at height H result in a corresponding change in the height $h_e$. More specifically, if processing tolerances result in an error which causes the height H to be slightly greater than desired (thereby making grooves 430C slightly deeper than desired), then the height $h_e$ is slightly lowered. Consequently, the resulting error between the depth of grooves 430C and the height $h_e$ is less than the original error in forming the depth of grooves 430C.

Conversely, if processing tolerances result in an error which causes the height H to be slightly less than desired (thereby making grooves 430C slightly shallower than desired), then the height $h_e$ is slightly raised. Consequently, the resulting error between the depth of grooves 430C and the height $h_e$ is less than the original error in forming the depth of grooves 430C.

Figure 11:
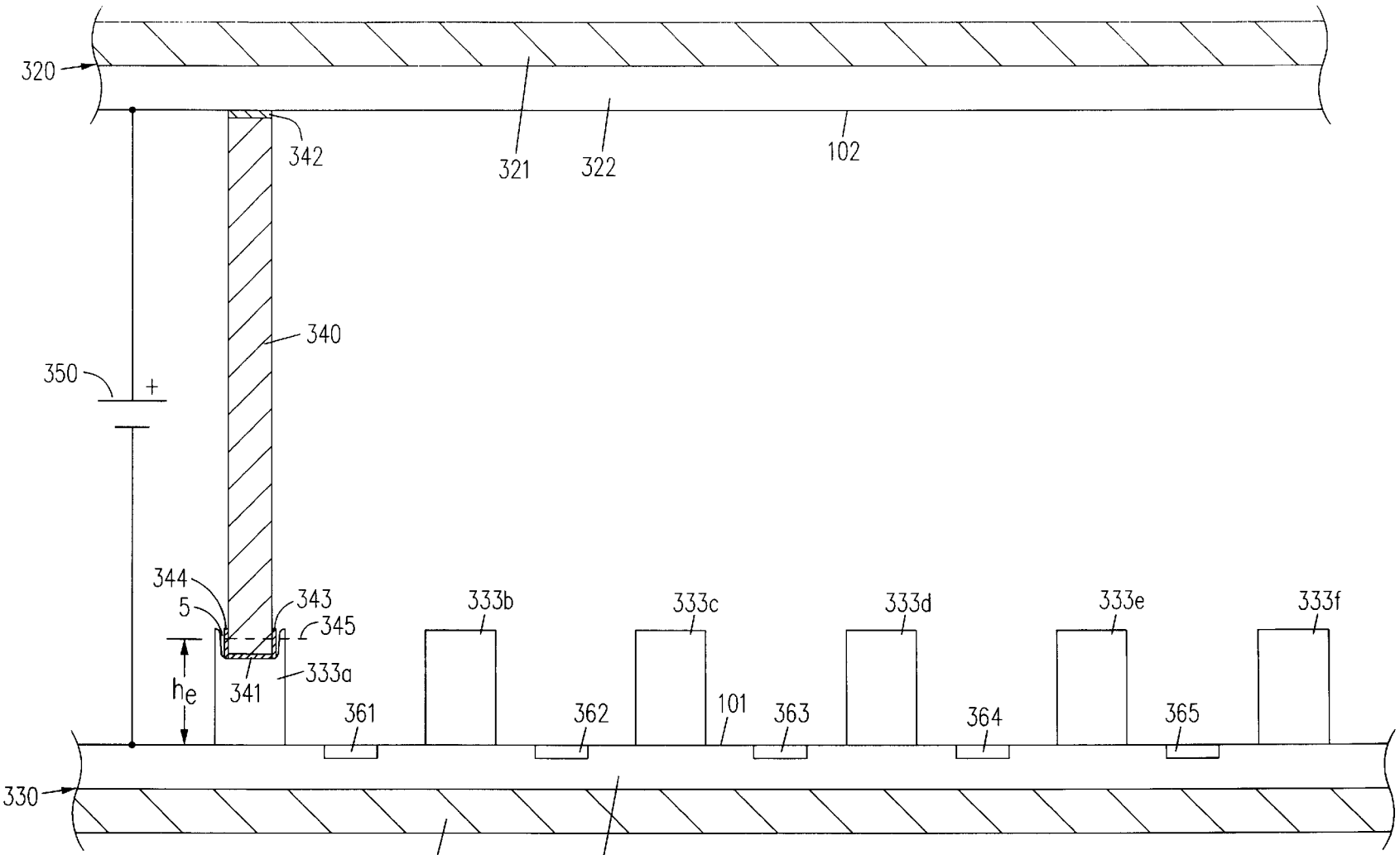
FIGS. 11–13 are cross sectional and schematic diagrams of portions of flat panel displays which utilize spacers having face electrodes in accordance with other embodiments of the invention.

FIG. 11 is a cross sectional and schematic diagram of a flat panel display 500 in accordance with a variation of the previously described embodiment. Because flat panel display 500 is similar to flat panel display 300, similar elements in FIGS. 3 and 11 are labeled with similar reference numbers. In the present variation, spacer 340 is modified to include electrically conductive face electrodes 343 and 344. Face electrodes 343 and 344, which are typically metal, contact edge electrode 341 and extend partially over opposite face surfaces of spacer 340. The fabrication of face electrodes 343 and 344 is described in more detail in commonly owned, co-pending U.S. patent application Ser. Nos. 08/404,408 and 08/505,841, both cited above.

Face electrodes 343 and 344 modify the electrical properties of spacer 340 such that the electrical end of spacer 340 is no longer coincident with edge electrode 341. Face electrodes 343 and 344 result in the electrical end of spacer 340 being moved up spacer 340 to electrical end plane 345. That is, spacer 340 (including edge electrode 341 and face electrodes 343 and 344) has a resistance which is equivalent to the resistance exhibited by a slightly shorter spacer having an edge surface (having an edge electrode, but no face electrodes) located at electrical end plane 345.

As illustrated in FIG. 11, the depth of groove 5 in flat panel display 500 is slightly deeper than the depth of groove 5 in flat panel display 300 (FIG. 3). The depth of groove 5 in flat panel display is located such that electrical end plane 345 of spacer 340 is coincident with the electrical end of electron emitting structure 332 and focusing structures 333*a*–333*f* at height $h_e$. By locating electrical end plane 345 in this manner, the voltage distribution along most of spacer 340 as illustrated in FIG. 11 is approximately equal to the voltage distribution in free space between electron emitting structure 332 (and focusing structures 333*a*–333*f*) and light emitting structure 322.

Although FIG. 11 illustrates two face electrodes 343 and 344, the same results can be obtained by using only one of face electrodes 343 or 344. The use of one face electrode can reduce the number of processing steps (and therefore processing costs) associated with fabricating spacer 340.

Figure 12:
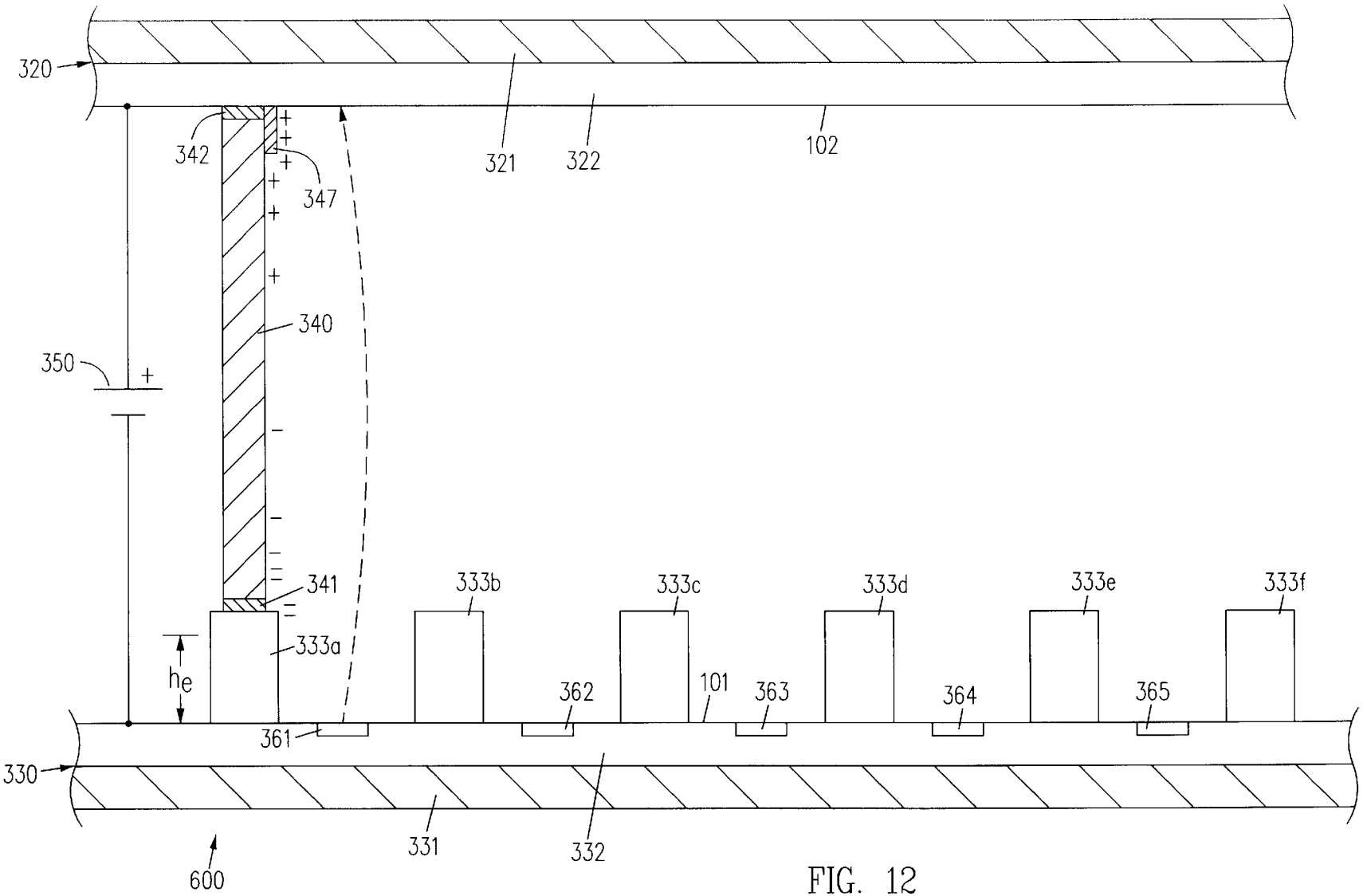

FIG. 12 is a cross sectional and schematic diagram of a flat panel display 600 in accordance with another variation of the previously described embodiments. Because flat panel display 600 is similar to flat panel display 300, similar elements in FIGS. 3 and 12 are labeled with similar reference numbers. In the variation illustrated in FIG. 12, focusing structure 333*a* does not include a groove at its upper surface. While this advantageously reduces the cost of fabricating focusing structures 333*a*–333*f*, the electrical end of spacer 340 (located coincident with edge electrode 341) is higher than the height $h_e$ of the electrical end of the combination of electron emitting structure 332 and focusing structures 333*a*–333*f*.

Consequently, an undesirable voltage distribution will exist near the interface of edge electrode 341 and focusing structure 333*a*. More specifically, the voltage at edge electrode 341 will be approximately 0 Volts, which is less than the desired voltage at this height. This voltage distribution is illustrated by negative (−) signs near edge electrode 341 since the voltage distribution near edge electrode 341 is negative with respect to the desired voltage distribution. Electrons emitted from electron emitting element 361 are deflected away from spacer 340 near edge electrode 341 because of this negative voltage distribution.

To correct for this electron deflection, a face electrode 347 is located adjacent to light emitting structure 322. Face electrode 347 contacts edge electrode 342. As a result, face electrode 347 is held at a voltage of V Volts. Because face electrode 347 extends partially down the face surface of spacer 340, face electrode 347 modifies the voltage distribution along spacer 340 near light emitting structure 322. This voltage distribution is illustrated by positive (+) signs near face electrode 347 since the voltage distribution near face electrode 347 is positive with respect the voltage distribution which would exist in the absence of face electrode 347. Electrons which were previously deflected away from spacer 340 near edge electrode 341 are therefore deflected back toward spacer 340 near face electrode 347. The length of face electrode 347 is selected such that the deflection caused by edge electrode 341 is canceled by the deflection caused by face electrode 347.

Modifications to this embodiment are possible. For example, face electrodes which contact edge electrode 342 can be formed on both face surfaces of spacer 340. In addition, edge electrode 341 can be located in a groove formed in the upper surface of focusing structure 333*a*, wherein the groove has a depth which causes edge electrode 341 (i.e., the electrical end of spacer 340) to be positioned above height $h_e$.

Figure 13:
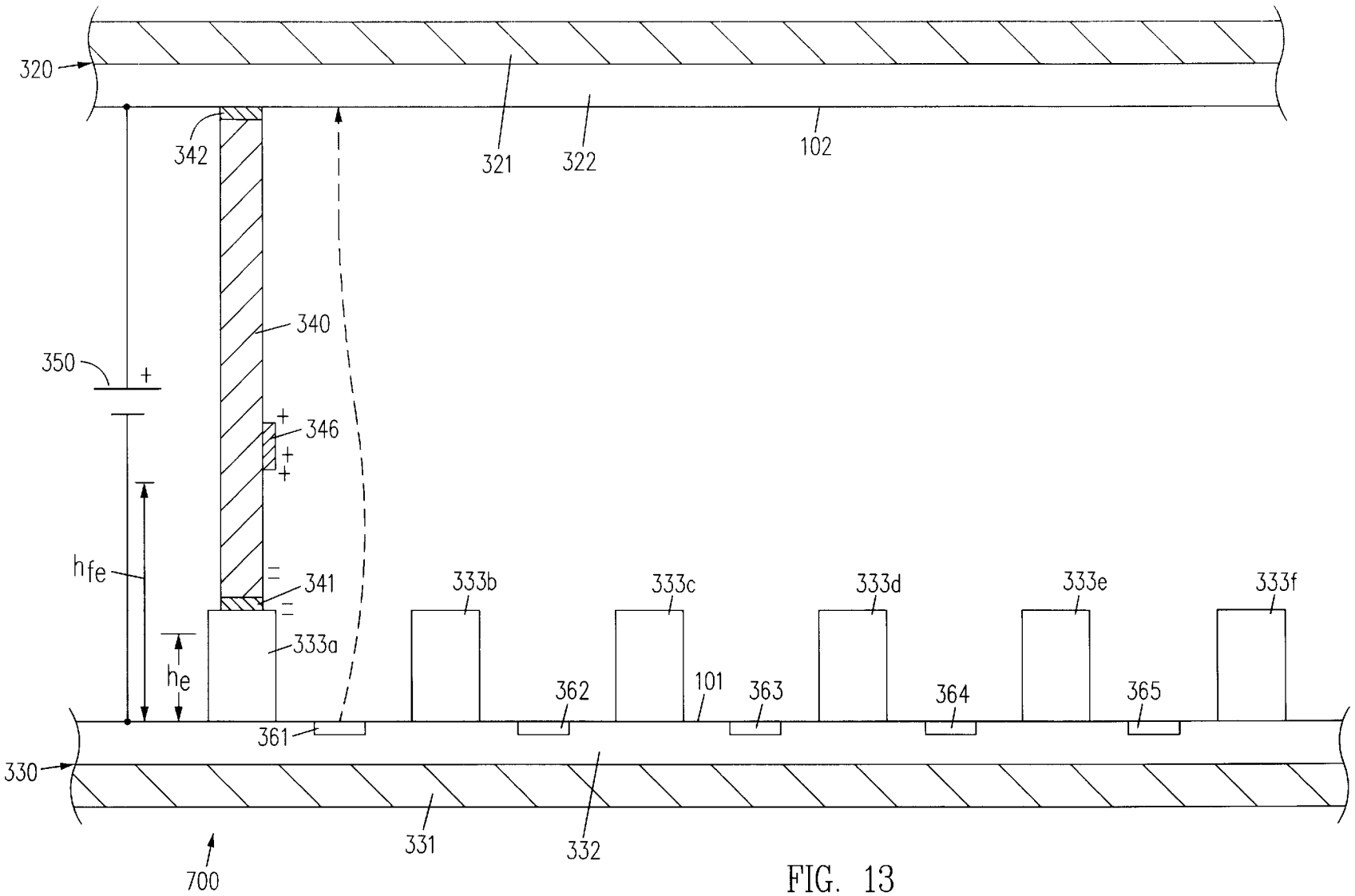

FIG. 13 is a cross sectional and schematic diagram of a flat panel display 700 in accordance with another variation of the previously described embodiments. Because flat panel display 700 is similar to flat panel display 600, similar elements in FIGS. 12 and 13 are labeled with similar reference numbers. In the variation illustrated in FIG. 13, spacer 340 is modified to include an electrically conductive face electrode 346 which is located on a face surface of spacer 340, physically separated from edge electrodes 341 and 342. Face electrode 346 is located at a height $h_{fe}$ above surface 101. A positive voltage is applied to face electrode 346 to correct for the negative voltage distribution which exists adjacent to edge electrode 341. This voltage can be applied in several different ways.

Figure 14:
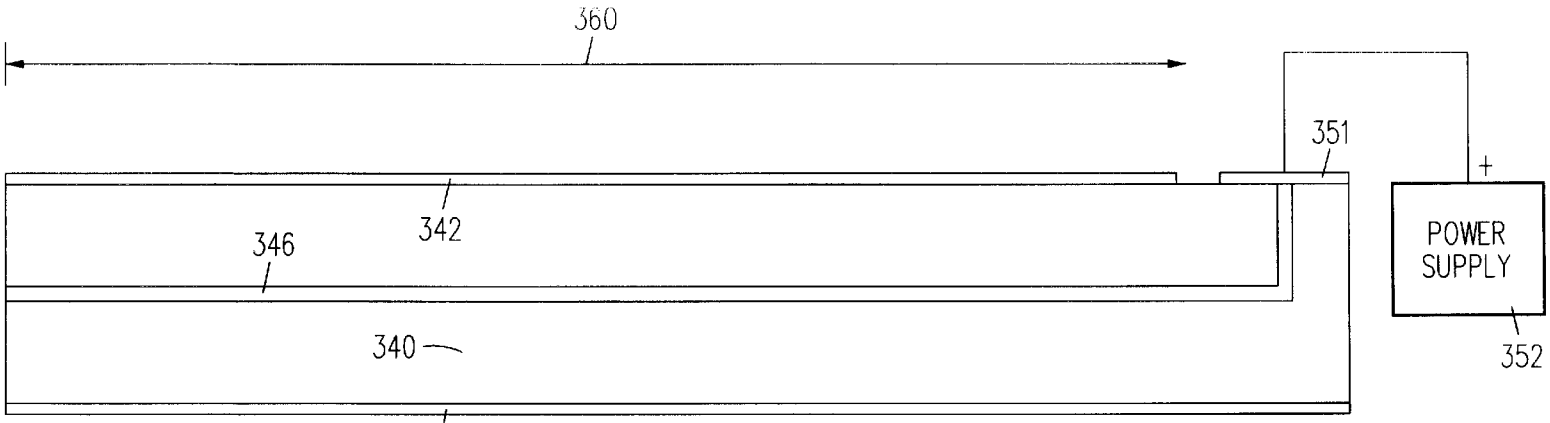
FIGS. 14–17 are side views of spacers used in the embodiment illustrated by FIG. 13.

FIG. 14 is a side view of spacer 340 in accordance with one embodiment. Face electrode 346 extends in parallel with edge electrodes 341 and 342 within active region 350. Outside of active region 350, face electrode 346 extends upward to contact edge electrode 351. Edge electrode 351 is located on the same edge surface as edge electrode 342, but is electrically isolated from edge electrode 342 by a gap. Edge electrode 351 is connected to power supply 352. Power supply 352 is adjusted to apply a voltage to face electrode 346 which corrects for the negative voltage distribution which exists adjacent to edge electrode 341. The voltage applied to face electrode 346 is positive with respect to the voltage which would otherwise exist along spacer 340 at height $h_{fe}$ in the absence of face electrode 346.

Figure 15:
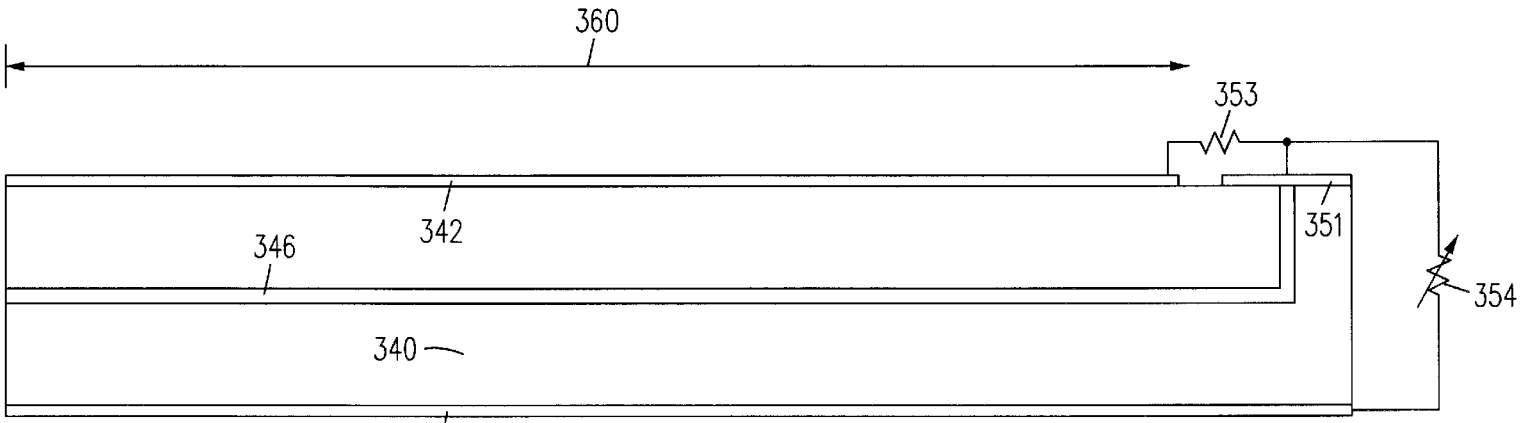

FIG. 15 is a side view of spacer 340 in accordance with another embodiment. In this embodiment, a first resistor 361 is connected between edge electrode 342 and edge electrode 351. A second resistor 362 is connected between edge electrode 351 and edge electrode 341. Resistors 361 and 362 form a voltage divider circuit. As previously described, edge electrode 342 is held at the high voltage V and edge electrode 341 is held at the low voltage of approximately 0 Volts. Thus, the voltage at face electrode 346 is maintained at a voltage between V and 0 Volts, depending on the values of resistors 361 and 362. Resistor 362 is a variable resistor which allows the voltage divider circuit to be adjusted to provide the appropriate voltage to face electrode 346. Again, the voltage applied to face electrode 346 is adjusted to correct for the negative voltage distribution which exists adjacent to edge electrode 341.

Figure 16:
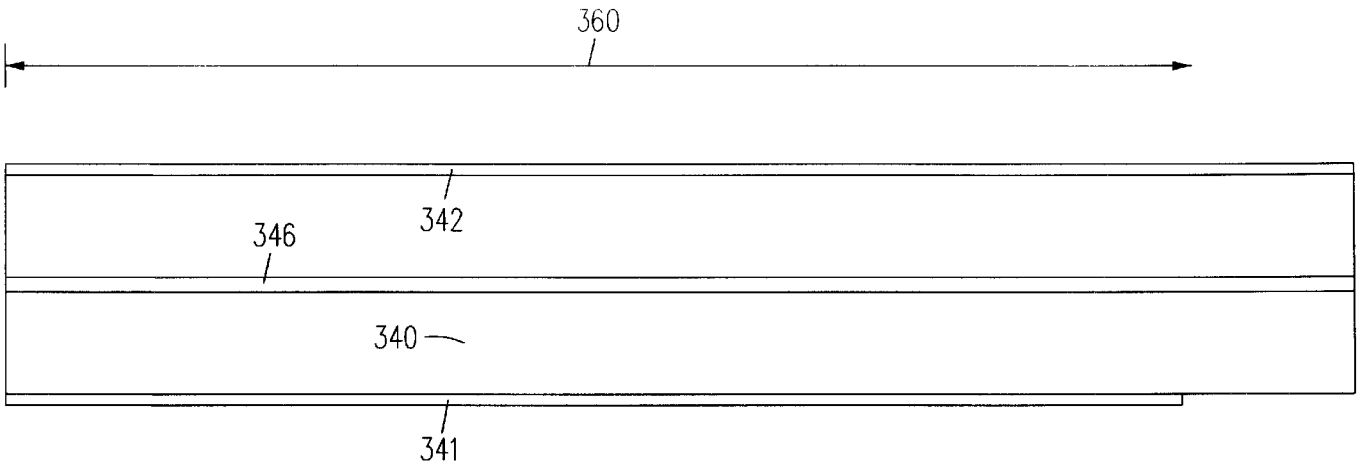

FIG. 16 is a side view of spacer 340 in accordance with yet another embodiment. In FIG. 16, edge electrode 342 is continuous along the entire upper edge surface of spacer 340. However, edge electrode 341 does not extend all the way across the lower edge surface of spacer 340. Rather, edge electrode 341 extends only to the edge of the active region 350 of spacer 340. The portion of edge electrode 342 which extends outside of active region 350 causes the voltage of face electrode 346 to increase slightly, such that the voltage on face electrode 346 becomes slightly closer to the high voltage V applied to edge electrode 342. Conversely, if it is desirable to lower the voltage of face electrode 346, then edge electrode 341 is modified to extend along the entire lower edge surface of spacer 340, while the portion of edge electrode 342 which extends outside of the active region 350 is eliminated.

Figure 17:
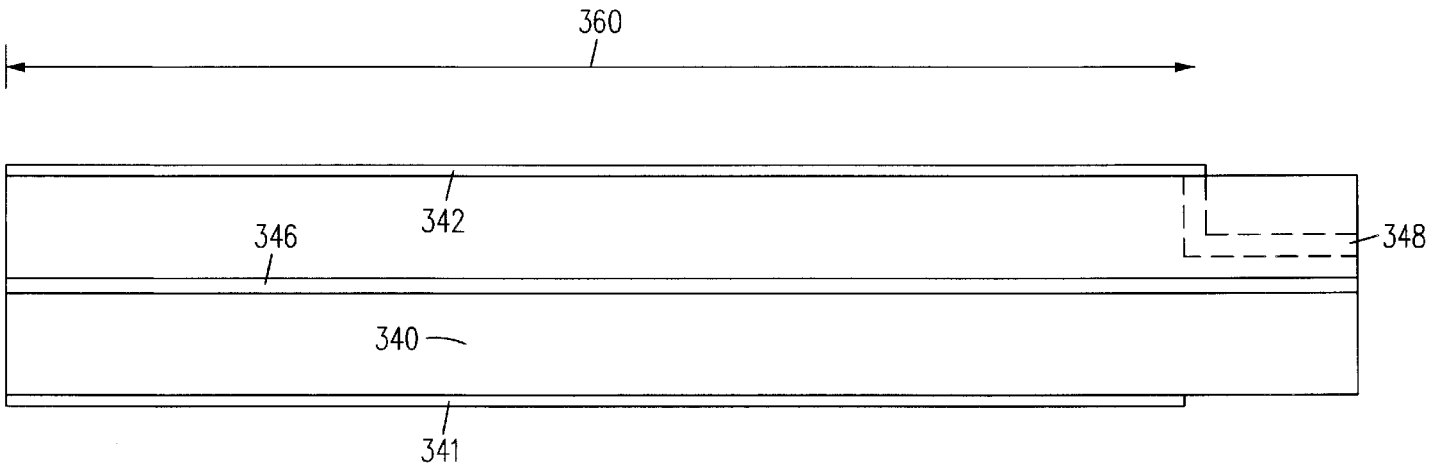

FIG. 17 is a side view of spacer 340 in accordance with a variation of the spacer 340 illustrated in FIG. 16. In spacer 340 of FIG. 17, edge electrode 342 extends only to the edge of active region 350. An extension electrode 348 contacts edge electrode 342 at the edge of active region 350 and extends downward along the rear surface of spacer 340. The rear surface of spacer 340 is defined as the surface which is opposite the surface on which face electrode 346 is located. Extension electrode 348 causes the voltage on face electrode 346 to be higher than the voltage which would otherwise be present on face electrode 346 if edge electrode 341 extended all the way across the upper edge of spacer 340. By locating extension electrode 348 on the rear surface, arcing between extension electrode 348 and face electrode 346 is prevented.

Figure 18:
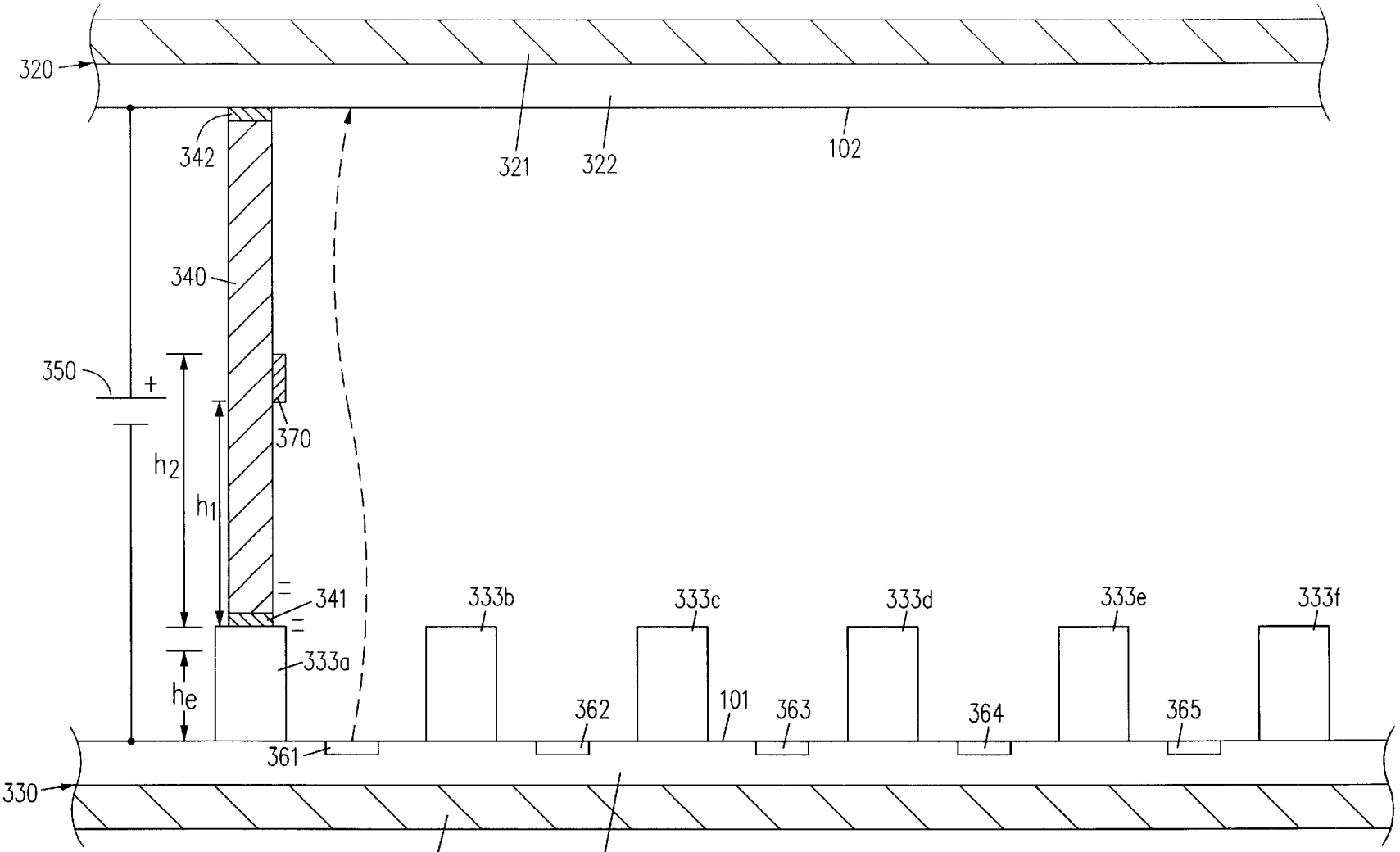
FIG. 18 is a cross sectional and schematic view of a portion of a flat panel display which utilizes a spacer having a face electrode in accordance with another embodiment of the invention.

FIG. 18 is a cross sectional and schematic view of a portion of a flat panel display 1100 in accordance with another embodiment of the invention. Because flat panel display 1100 is similar to flat panel display 700, similar elements in FIGS. 13 and 18 are labeled with similar reference numbers. In the embodiment illustrated in FIG. 18, spacer 340 includes an electrically conductive face electrode 370.

Figure 19:
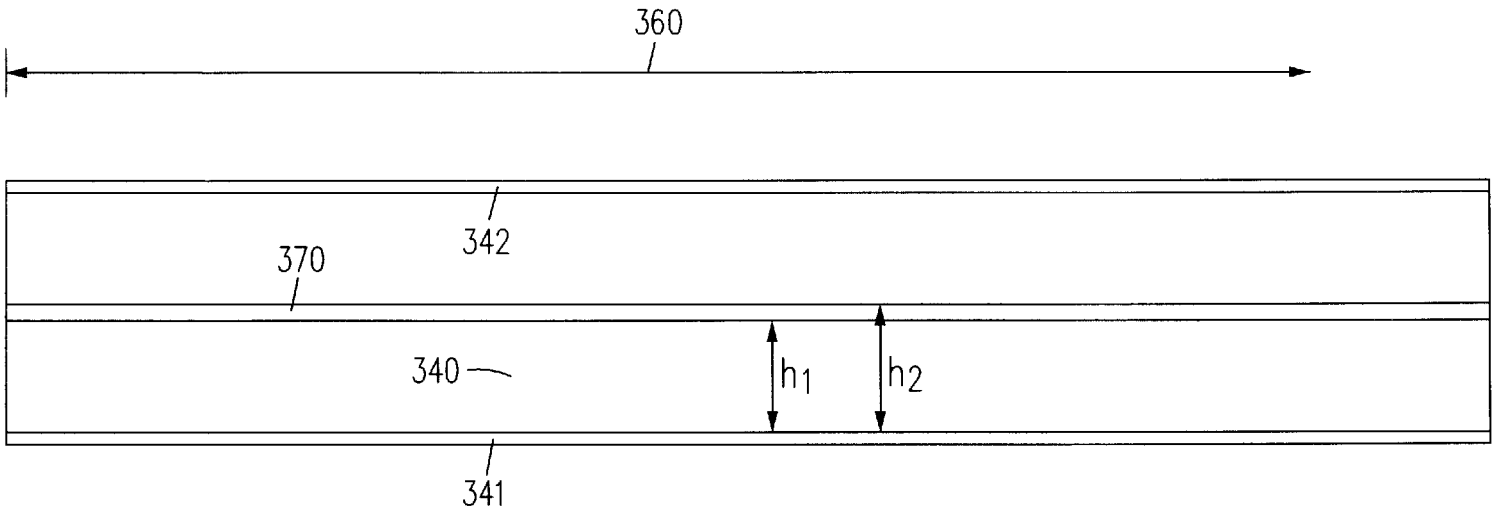
FIG. 19 is a side view of a spacer used in the embodiment of FIG. 18.

FIG. 19 is a side view of the spacer 340 of FIG. 18. As illustrated in FIG. 19, face electrode 370 extends across the face surface of spacer 340 in parallel with edge electrodes 341 and 342. Face electrode 370 is not directly connected to an external voltage supply. The lower edge of face electrode 346 is located at a first height h, from edge electrode 341. The upper edge of face electrode 346 is located a second height $h_2$ from edge electrode 341.

Figure 20:
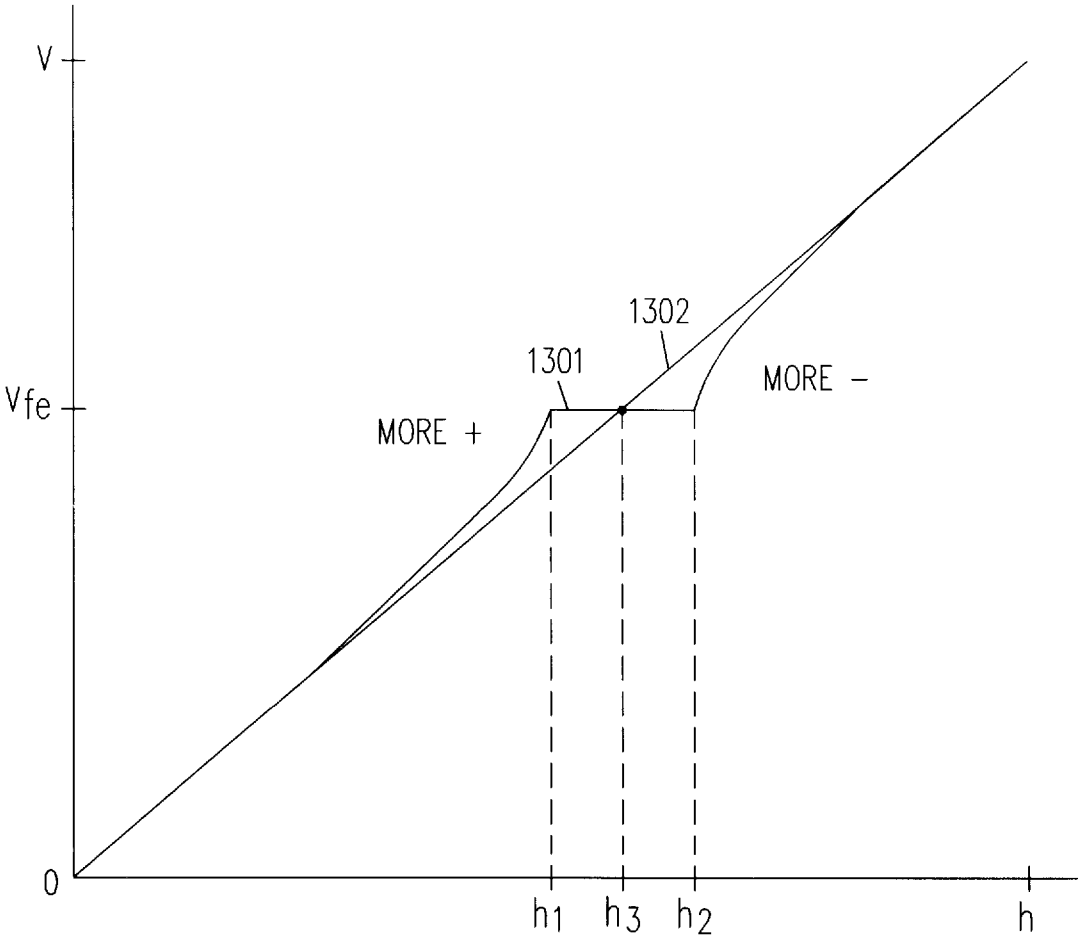
FIG. 20 is a graph of the voltage distribution along the spacer of FIGS. 18 and 19.

FIG. 20 is a graph illustrating the voltage distribution along spacer 340 of FIG. 18. Line 1301 illustrates the voltage distribution along spacer 340. Line 1302 illustrates the voltage distribution which would exist along spacer 340 in the absence of face electrode 370. Because face electrode 370 is electrically conductive, the voltage along the height of face electrode, from $h_1$ to $h_2$, is maintained at an approximately constant voltage $V_{fe}$. Lines 1301 and 1302 exhibit the same voltage $V_{fe}$ at height $h_3$. Below height $h_3$, line 1301 exhibits a voltage which is positive with respect to line 1302. Above height $h_3$, line 1301 exhibits a voltage which is negative with respect to line 1302. Thus, below height $h_3$, a spacer which includes face electrode 370 will exert a greater attractive force on electrons than the same spacer in the absence of face electrode 370. Similarly, above height $h_3$, a spacer which includes face electrode 370 will exert a greater repulsive force on electrons than the same spacer in the absence of face electrode 370.

Electrons emitted from electron emitting element 361 accelerate when travelling toward light emitting structure 322. Thus, these electrons are moving relatively slowly near electron emitting element 361, and relatively fast near light emitting structure 322. Slower moving electrons are more likely to be attracted or repelled in response to the voltage distribution on spacer 340. Because the electrons emitted from emitter 361 are moving more slowly below height $h_3$ than above height $h_3$, the increased attractive force which is introduced by face electrode 370 below height $h_3$ will have a greater effect on these electrons than the increased repulsive force which is introduced by face electrode 370 above height $h_3$. The net effect is that the electrons emitted from electron emitting element 361 are slightly attracted toward spacer 340. As a result, face electrode 370 can be used to correct for the negative voltage distribution which exists adjacent to edge electrode 341. The net attractive force introduced by face electrode 370 can be adjusted by varying heights $h_1$ and $h_2$.

Although the invention has been described in connection with several embodiments, it is understood that this invention is not limited to the embodiments disclosed, but is capable of various modifications which would be apparent to one of ordinary skill in the art. For example, in particular embodiments, the lower surface of light emitting structure 322 can have a non-planar surface. This can occur for example, when light emitting structure 322 includes a black matrix which has an electrical end which is not coincident with the physical end of the black matrix. In such an embodiment, the electrical end of the light emitting structure is determined, a groove is formed in the light emitting structure which is at least as deep as the electrical end of the light emitting structure, and the spacer is located within the groove, with the electrical end of the spacer being located coincident with the electrical end of the light emitting structure. Thus, the invention is limited only by the following claims.

What is claimed is:

1. A flat panel display comprising:

a faceplate structure having a light emitting structure;

a backplate structure having an electron emitting structure;

a focusing structure having a first surface coupled to the electron emitting structure and a second surface which extends away from the electron emitting structure, the focusing structure and the electron emitting structure having an electrical end between the first and second surfaces of the focusing structure; and a spacer located between the focusing structure and the faceplate structure, the spacer situated in a groove in the focusing structure and having an electrical end located such that the voltage distribution along most of the spacer approximately equals the voltage distribution which exists in free space between (a) the light emitting structure and (b) the focusing structure and the electron emitting structure.

2. The flat panel display of claim 1, wherein the spacer comprises material having a substantial uniform electrical resistivity.

3. The flat panel display of claim 1, wherein the groove is coincident with the electrical end of the focusing structure and the electron emitting structure.

4. The flat panel display of claim 3, wherein the spacer further comprises an electrically conductive edge electrode located at an edge of the spacer, the edge electrode being positioned in the groove.

5. The flat panel display of claim 1, wherein the groove extends below the electrical end of the focusing structure and the electron emitting structure.

6. The flat panel display of claim 5, further comprising an electrically conductive edge electrode located at an edge of the spacer and one or more electrically conductive face electrodes which contact the edge electrode and extend partially over opposing face surfaces of the spacer, wherein the electrical end of the spacer is distal from the physical end of the spacer.

7. A flat panel display comprising:

a faceplate structure;

a backplate structure having an electron emitting structure;

a focusing structure having a first surface coupled to the electron emitting structure and a second surface which extends away from the electron emitting structure, the focusing structure and the electron emitting structure having an electrical end between the first and second surfaces of the focusing structure;

a spacer located between the focusing structure and the faceplate structure, the spacer having an electrical end located above the electrical end of the focusing structure and the electron emitting structure;

a face electrode located an a face surface of the spacer; and means for controlling the voltage of the face electrode to create, adjacent to the face electrode, a voltage distribution which compensates for the voltage distribution caused by the electrical end of the spacer being located above the electrical end of the focusing structure and the electron emitting structure, the controlling means comprising (a) a first edge electrode located at a first edge surface of the spacers, extending along only part of the first edge surface, and contacting the backplate structure and (b) a second edge electrode located at a second edge suface of the spacer and contacting the faceplate structure.

8. The flat panel display of claim 7, wherein the first edge electrode does not extend past an active region of the flat panel display.

9. The flat panel display of claim 7, further comprising an extension electrode coupled to the second edge electrode, wherein the extension electrode extends toward the first edge electrode along a face surface of the spacer opposite the surface of the spacer on which the face electrode is located.

10. A flat panel display comprising:

an electron emitting structure;

a focusing structure having a first surface coupled to the electron emitting structure and a second surface which extends away from the electron emitting structure, the focusing structure and the electron emitting structure having an electrical end between the first and second surfaces of the focusing structure; and one or more grooves located along the second surface of the focusing structure, each groove having a bottom surface coincident with the electrical end of the focusing structure and the electron emitting structure.

11. The flat panel display of claim 10, wherein the focusing structure is shaped like a grid.

12. The flat panel display of claim 10, wherein the focusing structure further comprises:

a plurality of parallel first spacer portions;

a plurality of parallel second spacer portions, wherein the plurality of second spacer portions are located over the plurality of first spacer portions, the plurality of first spacer portions being perpendicular to the plurality of second spacer portions.

13. The flat panel display of claim 12, wherein each groove comprises a bottom and sidewalls, the first spacer portions defining the bottoms of each groove, and the second spacer portions defining the sidewalls of each groove.

14. The flat panel display of claim 12, wherein the electron emitting structure comprises a plurality of parallel electrodes, wherein the first spacer portions are aligned with the parallel electrodes.

15. A method of fabricating a flat panel display comprising (a) a faceplate structure having a light emitting structure and (b) a backplate structure having an electron emitting structure, the method comprising the steps of:

providing a focusing structure over the electron emitting structure of the backplate structure, the focusing structure and the electron emitting structure having an electrical end;

forming a groove in the focusing structure; and locating a spacer in the groove, the spacer having an electrical end located such that the voltage distribution along most of the spacer approximately equals the voltage distribution which exists in free space between (a) the light emitting structure and (b) the focusing structure and the electron emitting structure.

16. A method of fabricating a flat panel display comprising a faceplate structure and a backplate structure having an electron emitting structure, the method comprising the steps of:

providing a focusing structure over the electron emitting structure of the backplate structure, the focusing structure and the electron emitting structure having an electrical end;

locating a spacer having an electrical end on the focusing structure such that the electrical end of the spacer is located above the electrical end of the focusing structure and the electron emitting structure;

providing a face electrode on a face surface of the spacer;

providing first and second edge electrodes respectively at opposite first and second edge surfaces of the spacer so as to respectively contact the backplate structure and the faceplate structure, at least one of the edge electrodes extending along only part of the edge surface at which that edge electrode is located; and controlling the voltage of the face electrode to create, adjacent to the face electrode, a voltage distribution which compensates for the voltage distribution caused by the electrical end of the spacer being located above the electrical end of the focusing structure and the electron emitting structure.

17. The method of claim 16, wherein the step of controlling the voltage of the face electrode comprises connecting the face electrode to the faceplate structure.

18. The method of claim 16, wherein the step of controlling the voltage of the face electrode comprises connecting the face electrode to a power supply.

19. The method of claim 16, wherein the step of controlling the voltage of the face electrode comprises connecting the face electrode to a voltage divider circuit.

20. The method of claim 16, wherein the step of controlling the voltage of the face electrode comprises connecting the second edge electrode to an extension electrode located on a face surface of the spacer opposite the face surface of the spacer on which the face electrode is located, the extension electrode being located outside of the active region of the flat panel display, wherein the extension electrode extends toward the first edge electrode.

21. The method of claim 16, wherein the step of controlling the voltage of the face electrode comprises locating the face electrode at a predetermined height along the face surface of the spacer.

22. The flat panel display of claim 1, wherein the spacer comprises a spacer wall.

23. The flat panel display of claim 7, wherein the spacer comprises a spacer wall.

24. The method of claim 15, wherein the spacer comprises a spacer wall.

25. The method of claim 16, wherein the spacer comprises a spacer wall.

26. The flat panel display of claim 1 wherein the electrical end of the spacer is coincident with the electrical end of the focusing structure and the electron emitting structure.

27. The flat panel display of claim 7, wherein the second edge electrode extends along only part of the second edge surface.

28. The flat panel display of claim 9, wherein the second edge electrode extends along part of the second edge surface to where the second edge electrode connects to the extension electrode.

29. The method of claim 15 wherein the electrical end of the spacer is coincident with the electrical end of the focusing structure and the electron emitting structure.

30. A flat panel display comprising:

a faceplate structure;

a backplate structure having an electron emitting structure;

a focusing structure having a first surface coupled to the electron emitting structure and a second surface which extends away from the electron emitting structure, the focusing structure and the electron emitting structure having an electrical end between the first and second surfaces of the focusing structure;

a spacer located between the focusing structure and the faceplate structure, the spacer having an electrical end located above the electrical end of the focusing structure and the electron emitting structure;

a face electrode located on a face surface of the spacer; and means for controlling the voltage of the face electrode to create, adjacent to the face electrode, a voltage distribution which compensates for the voltage distribution caused by the electrical end of the spacer being located above the electrical end of the focusing structure and the electron emitting structure, the controlling means comprising (a) a first edge electrode located at a first edge surface of the spacer and contacting the focusing structure and (b) a second edge electrode located at a second edge surface of the spacer, extending along only part of the second edge surface, and contacting the faceplate structure.

31. The flat panel display of claim 30, wherein the controlling means further comprises an additional edge electrode located at the second edge surface, spaced apart from the second edge electrode, and electrically coupled to the face electrode.

32. The flat panel display of claim 31, wherein the controlling means further comprises means for applying a voltage to the face electrode.

33. The flat panel display of claim 32, wherein the voltage-applying means comprises a power supply.

34. The flat panel display of claim 32, wherein the voltage-applying means comprises: (a) first resistor coupled between the first edge electrode and the face electrode and (b) a second resistor coupled between the second edge electrode and the face electrode.

35. The flat panel display of claim 30, wherein the spacer comprises a spacer wall.

* * * * *